US012018433B2

(12) United States Patent
Lee et al.

(10) Patent No.: US 12,018,433 B2
(45) Date of Patent: Jun. 25, 2024

(54) PROCESS FOR TREATING MICROFIBRILLATED CELLULOSE

(71) Applicant: FiberLean Technologies Limited, Cornwall (GB)

(72) Inventors: Kai Lee, Par Cornwall (GB); Guillaume Tellier, Par Cornwall (GB); Felix John Gunner Bacon, Par Cornwall (GB); David Robert Skuse, Par Cornwall (GB)

( * ) Notice: Subject to any disclaimer, the term of this patent is extended or adjusted under 35 U.S.C. 154(b) by 135 days.

(21) Appl. No.: 17/579,215

(22) Filed: Jan. 19, 2022

(65) Prior Publication Data

US 2022/0145536 A1 May 12, 2022

Related U.S. Application Data

(60) Continuation of application No. 16/922,410, filed on Jul. 7, 2020, now abandoned, which is a division of application No. 14/775,519, filed as application No. PCT/EP2014/055102 on Mar. 14, 2014, now Pat. No. 10,745,857.

(30) Foreign Application Priority Data

Mar. 15, 2013 (EP) ..... 13290070

(51) Int. Cl.

| | |
|---|---|
| ***D21C 9/00*** | (2006.01) |
| ***D21H 11/18*** | (2006.01) |
| ***D21H 17/67*** | (2006.01) |
| ***D21H 21/20*** | (2006.01) |

(52) U.S. Cl.

CPC ..... *D21C 9/007* (2013.01); *D21H 11/18* (2013.01); *D21H 17/675* (2013.01); *D21H 21/20* (2013.01)

(58) Field of Classification Search

CPC ..... D21C 9/007; D21C 9/004; D21H 11/18

See application file for complete search history.

(56) References Cited

U.S. PATENT DOCUMENTS

| | | | |
|---|---|---|---|
| 4,374,702 | A | 2/1983 | Turbak et al. |
| 5,964,983 | A | 10/1999 | Dinand et al. |
| 6,183,596 | B1 | 2/2001 | Matsuda et al. |
| 6,202,946 | B1 | 3/2001 | Virtanen |
| 2005/0194477 | A1 | 9/2005 | Suzuki |
| 2011/0259537 | A1 | 10/2011 | Husband et al. |

(Continued)

FOREIGN PATENT DOCUMENTS

| | | | |
|---|---|---|---|
| CN | 102378777 | A | 3/2012 |
| CN | 102753752 | A | 10/2012 |

(Continued)

OTHER PUBLICATIONS

Brazilian Office Action dated Apr. 5, 2022 for corresponding Brazilian Patent Application No. 122021020683-0, 12 pages.

(Continued)

*Primary Examiner* — Anthony Calandra

(74) *Attorney, Agent, or Firm* — Raymond G. Arner; Pierce Atwood LLP

(57) ABSTRACT

A process for modifying the paper burst strength enhancing attributes of microfibrillated cellulose, an aqueous suspension comprising said microfibrillated cellulose, and papermaking compositions and paper products comprising said microfibrillated cellulose.

26 Claims, 3 Drawing Sheets

(56) References Cited

U.S. PATENT DOCUMENTS

| | | | |
|---|---|---|---|
| 2012/0090192 | A1 | 4/2012 | Overboe et al. |
| 2012/0094953 | A1 | 4/2012 | Gane et al. |
| 2012/0107480 | A1 | 5/2012 | Gane et al. |
| 2012/0214979 | A1 | 8/2012 | Heiskanen et al. |
| 2014/0370179 | A1 | 12/2014 | Gane et al. |

FOREIGN PATENT DOCUMENTS

| | | | | |
|---|---|---|---|---|
| EP | 0614948 | A1 | 9/1994 | |
| EP | 1538257 | A1 | 6/2005 | |
| JP | 07310296 | A | 11/1995 | |
| JP | H07-310296 | A | 11/1995 | |
| JP | 3036354 | B2 | 4/2000 | |
| JP | 2010-502847 | A | 1/2010 | |
| JP | 2010-502848 | A | 1/2010 | |
| JP | 2010502847 | A | 1/2010 | |
| JP | 2012-514137 | A | 6/2012 | |
| JP | 2012514137 | A | 6/2012 | |
| JP | 2012-522093 | A | 9/2012 | |
| JP | 2012522093 | A | 9/2012 | |
| JP | 2014-503696 | A | 2/2014 | |
| JP | 2014503696 | A | 2/2014 | |
| JP | 2014-510845 | A | 5/2014 | |
| JP | 2014510845 | A | 5/2014 | |
| KR | 10-2011-0091025 | A | 8/2011 | |
| KR | 1020110091025 | A | 8/2011 | |
| WO | 2004/009902 | A1 | 1/2004 | |
| WO | 2008/027096 | A1 | 3/2008 | |
| WO | 2010/131016 | A2 | 11/2010 | |
| WO | 2010131016 | A2 | 11/2010 | |
| WO | 2012/066308 | A2 | 5/2012 | |
| WO | WO-2014029909 | A1 * | 2/2014 | ..... C08L 1/02 |

OTHER PUBLICATIONS

Japanese Office Action dated Oct. 24, 2022 for corresponding Japanese Patent Application No. 2021-172095, 6 pages.
Canadian Office Action dated Jul. 5, 2022 for corresponding Canadian Patent Application No. 2,906,283, 5 pages.
Canadian Office Action dated Dec. 3, 2021 for corresponding Canadian Patent Application No. 2,906,283, 5 pages.
European Office Action dated Mar. 24, 2022 for corresponding European Patent Application No. 18184556.1, 4 pages.
Chinese Office Action and Search Report for corresponding Chinese Patent Application No. 201480026782.4, dated Apr. 3, 2018, 20 pages.
European Search Report for corresponding European Patent Application No. 18184556.1, dated Oct. 4, 2018, 6 pages.
Japanese Office Action for corresponding Japanese Patent Application No. 2015-562195, dated Mar. 19, 2018, 12 pages.
Phipps, Jonathan, "Choosing Fillers for Optimum Paper Properties: Understanding the Comprosies," Paper Technology vol. 42 No. 7, Sep. 2001, pp. 37-41.
Canadian Office Action for corresponding Canadian Patent Application No. 2906,283, dated Apr. 2, 2020, 5 pages.
Notice of Opposition against EP2971347, EP Application No. 14711725.3, dated Apr. 29, 2019 from European Patent Office, 60 pages.
Response to Notice of Opposition Against EP2971347, dated Nov. 25, 2019, submitted to the European Patent Office, 41 pages.
Japanese Office Action for corresponding Japanese Patent Application No. 2019-027341, dated Mar. 2, 2020, 2 pages.
Jin, H., et al. "Superhydrophobic and Superoleophobic Nanocellulose Aerogel Membranes as Bioinspired Cargo Carriers on Water and Oil," Langmuir (2011), 7, pp. 1930-1934.
Masuko Sangyo Product Information, Information, vol. 15E, ISO 9001, 24 pages.
European Office Action for corresponding European Patent Application No. 18184556.1, dated Sep. 10, 2019, 6 pages.
Wegner et al., "A Fundamental Review of the Relationship Between Nanotechnology and Lignocellulosic Biomass", The Nanoscient and Technology of Renewable Biomaterials, 2009, Lucian et al., (eds.) 43 pages.
Translation of Fourth Office Action issued by China National Intellectual Property Administration dated Jan. 9, 2019, for Chinese Patent Application No. 201480026782.4 (8 pages).
Chinese Office Action and Search Report for corresponding Chinese Patent Application No. 201480026782.4, dated Oct. 10, 2016, 26 pages.
Chinese Office Action for corresponding Chinese Patent Application No. 201480026782.4, dated Jul. 6, 2017, 29 pages.
European Office Action for corresponding European Patent Application No. 14711725.3, dated Feb. 24, 2017, 3 pages.
International Preliminary Report on Patentability and Written Opinion for corresponding International Patent Application No. PCT/EP2014/055102, dated Sep. 24, 2015, 10 pages.
International Search Report dated Jun. 20, 2014, for corresponding International Patent Application No. PCT/EP2014/055102 dated Mar. 14, 2014.
"Paper Coating Pigments," Tappi Monograph Series No. 30, 1966, pp. 34-35.
"Coated-Paper Producers Look Forward to Brighter Times," Pulp & Paper International, 1994, pp. 18-31.
Chinese Office Action for corresponding Chinese Patent Application No. 201910947938.7 dated Jun. 8, 2021, 23 pages.
Canadian Office Action for corresponding Canadian Patent Application No. 2,906,283, dated Dec. 3, 2020, 4 pages.
Japanese Office Action for corresponding Japanese Patent Application No. 2019-027341, dated Feb. 10, 2021, 2 pages.
Canadian Office Action dated Apr. 4, 2023 in corresponding Canadian Patent Application No. 2,906,283, 5 pages.
Second Japanese Office Action dated May 1, 2023 in corresponding Japanese Patent Application No. 2021-172095, 4 pages.
Non-Final Office Action dated Feb. 1, 2023 in corresponding U.S. Appl. No. 16/922,410, 45 pages.

* cited by examiner

PROCESS FOR TREATING MICROFIBRILLATED CELLULOSE

CROSS REFERENCE TO RELATED APPLICATIONS

This application is a continuation application of U.S. application Ser. No. 16/922,410, filed Jul. 7, 2020, which is a divisional application of U.S. application Ser. No. 14/775,519, filed Sep. 11, 2015 (now U.S. Pat. No. 10,745,857), which is a 3.71 National Stage application of PCT/EP14/055102 filed Mar. 14, 2014, which claims the benefit of European Patent Application No. 13290070.5, filed Mar. 13, 2013, the entire contents of which is incorporated herein by reference.

TECHNICAL FIELD

The present invention is directed to a process for modifying the paper burst strength enhancing attributes of microfibrillated cellulose, to an aqueous suspension comprising said microfibrillated cellulose, and to papermaking compositions and paper products comprising said microfibrillated cellulose.

BACKGROUND OF THE INVENTION

In the manufacture of paper, mineral fillers are commonly added. Whilst this may in some circumstances reduce the mechanical strength of the paper, i.e., relative to a paper made purely from a fibrous pulp, this is tolerated because the mechanical strength (albeit reduced) is still acceptable and there is a cost, quality and environmental benefit in being able to reduce the amount of fibre in the paper. A common property for assessing mechanical strength of paper is paper burst strength. Typically, a paper made purely from a fibrous pulp will have a higher paper burst strength than a comparable paper in which a portion of the fibrous pulp has been replaced by a mineral filler. The paper burst strength of the filled paper can be expressed as a percentage of the paper burst strength of the unfilled paper.

WO-A-2010/131016 discloses a process for preparing microfibrillated cellulose comprising microfibrillating, e.g., by grinding, a fibrous material comprising cellulose, optionally in the presence of grinding medium and inorganic particulate material. When used as a filler in paper, for example, as a replacement or partial replacement for a conventional mineral filler, the microfibrillated cellulose obtained by said process, optionally in combination with inorganic particulate material, was unexpectedly found to improve the burst strength properties of the paper. That is, relative to a paper filled with exclusively mineral filler, paper filled with the microfibrillated cellulose was found to have improved burst strength. In other words, the microfibrillated cellulose filler was found to have paper burst strength enhancing attributes. In one particularly advantageous embodiment of that invention, the fibrous material comprising cellulose was ground in the presence of a grinding medium, optionally in combination with inorganic particulate material, to obtain microfibrillated cellulose having a fibre steepness of from 20 to about 50.

Whilst the microfibrillated cellulose obtainable by the processes described in WO-A-2010/131016 has been shown to have advantageous paper burst strength enhancing attributes, it would be desirable to be able to modify, for example, further improve, one or more paper property enhancing attributes of microfibrillated cellulose, for example, the paper burst strength enhancing attributes of microfibrillated cellulose.

SUMMARY OF THE INVENTION

According to a first aspect, there is provided a process for treating microfibrillated cellulose, said process comprising subjecting an aqueous suspension comprising microfibrillated cellulose and optionally inorganic particulate material to high shear, wherein the high shear is generated, at least in part, by a moving shearing element. The treatment advantageously modifies, for example, Improves, a paper property enhancing attribute of the microfibrillated cellulose, for example, the paper burst strength enhancing attributes of the microfibrillated cellulose.

According to a second aspect, the process of the first aspect further comprises preparing a papermaking composition comprising microfibrillated cellulose, and optionally inorganic particulate material, obtainable by the process of the first aspect.

According to a third aspect, the process of the second aspect further comprises preparing a paper product from the papermaking composition.

According to a fourth aspect, there is provided an aqueous suspension comprising microfibrillated cellulose, and optionally inorganic particulate material, obtainable by the process of the first aspect of the present invention.

According to a fifth aspect, there is provided a papermaking composition obtainable by the process of the second aspect of the present invention.

According to a sixth aspect, there is provided a paper product obtainable by the process of the third aspect of the present invention, wherein the paper product has a first paper property (e.g., burst strength) which is greater than a second paper property (e.g., burst strength) of a comparable paper product comprising an equivalent amount of microfibrillated cellulose prior to high shear.

DETAILED DESCRIPTION OF THE INVENTION

Figure 1:
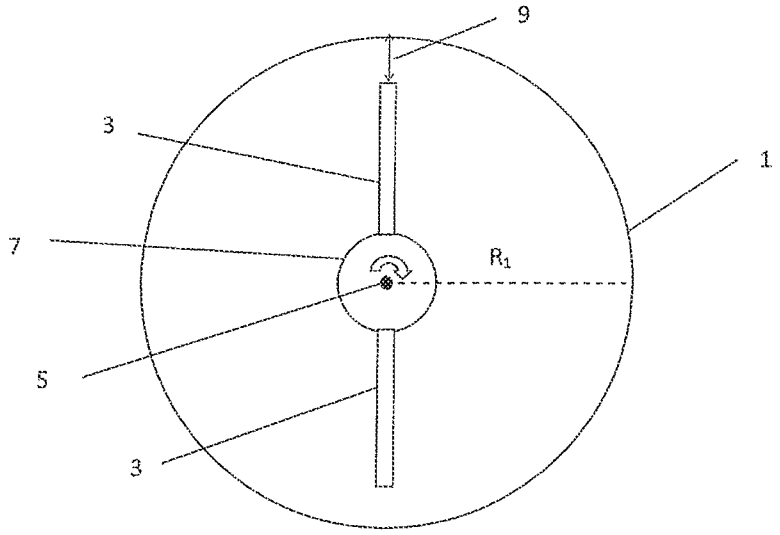
FIG. 1 is a schematic depiction, in plan view, of a rotor/stator configuration suitable for use in the present invention.

The process for treating microfibrillated cellulose comprises subjecting an aqueous suspension comprising microfibrillated cellulose and optionally inorganic particulate material to high shear, wherein the high shear is generated, at least in part, by a moving shearing element. The treatment advantageously modifies, for example, improves, a paper property enhancing attribute of the microfibrillated cellulose. The paper property may be a mechanical property and/or an optical property. In certain embodiments, the paper property is a mechanical property.

In certain embodiments, the process is for modifying, for example, improving, the paper burst strength enhancing attributes of microfibrillated cellulose and comprises subjecting the aqueous suspension comprising microfibrillated cellulose and optionally inorganic particulate material to high shear, wherein the high shear is generated, at least in part, by a moving shearing element, to modify the paper burst strength enhancing attributes of the microfibrillated cellulose.

As used herein, the term 'high shear' means the aqueous suspension comprising microfibrillated cellulose is subjected to shear which is sufficient to treat the microfibrillated cellulose in order to modify, for example, improve, a paper property enhancing attribute of the microfibrillated cellulose. In certain embodiments, the microfibrillated cellulose is subject to high shear which is sufficient to modify, for example, to improve, the paper burst strength enhancing attributes of the microfibrillated cellulose. Advantageously, the aqueous suspension comprising microfibrillated cellulose is subjected to shear which is sufficient to improve a paper property enhancing attribute of the microfibrillated cellulose, for example, the paper burst strength enhancing attributes of the microfibrillated cellulose. A person of ordinary skill in the art will be able to determine the shear which is sufficient to improve a paper property enhancing attribute of the microfibrillated cellulose, e.g., the paper burst strength enhancing attributes of the microfibrillated cellulose, by routine methods, e.g., by comparing, in a suitably controlled manner, the paper property enhancing attributes of the microfibrillated cellulose (e.g., the paper burst strength attributes of the microfibrillated cellulose) prior to shear treatment and the paper property enhancing attributes of the microfibrillated cellulose (e.g., the paper burst strength attributes of the microfibrillated cellulose) after shear treatment. Further details of such analysis is provided below in the Examples.

In certain embodiments, the paper property is selected from one or more of: burst strength, burst index, tensile strength, z-direction (Internal (Scott) bond) strength, tear strength), porosity, smoothness, and opacity.

A moving shearing element is a part or component which generates, at least in part, mechanical shear. As used herein, 'mechanical shear' means shear generated by the action of a moving mechanical part or component on the material being subjected to shear and, further, shear which is generated in the substantial absence of a pressure drop. An example of an apparatus relying on shear generated by a pressure drop is a homogenizer. Typically, in such an apparatus, the feed material passes from a high pressure zone to a low pressure zone through a valve with an adjustable, but fixed, gap, sometimes referred to as a homogenizing valve. In a homogenizer, therefore, there is no moving shearing element that directly applies shear to the material.

In certain embodiments, shear is generated by the action of a moving mechanical part or component with a complimentary fixed, i.e., stationary, part or component, wherein either or both of the moving mechanical part or component and the complimentary fixed part or component has more than one aperture, for example, more than 100 apertures, or more than 1000 apertures. In certain embodiments, at least the complimentary fixed part or component has more than one aperture, for example, more than 100 apertures, or more than 1000 apertures.

In certain embodiments, the term "high shear" means a shear rate of at least about 10,000 $s^{-1}$, for example, a rate of from about 10,000 $s^{-1}$ to about 120,000 $s^{-1}$, or from about 20,000 $s^{-1}$ to about 120,000 $s^{-1}$, or from about 40,000 $s^{-1}$ to about 110,000 $s^{-1}$, or from about 60,000 $s^{-1}$ to about 100,000 $s^{-1}$, or from about 70,000 $s^{-1}$ to about 90,000 $s^{-1}$, or from about 75,000 $s^{-1}$ to about 85,000 $s^{-1}$.

In certain embodiments, the moving shear element is a part or component of a high shear mixing apparatus. The moving shear element is housed within the high shear mixing apparatus and directly applies shear to the microfibrillated cellulose. In certain embodiments, the moving shear element is a rotor having mixing means at one end which is housed within, or positioned proximate to, a fixed, non-moving component or compartment, such as a stator, and the mixing means rotates about a central axis within the fixed component or compartment and directly applies shear to the microfibrillated cellulose. The speed of rotation of the rotor and, thus, the mixing means, is sufficient to generate high shear. The mixing means may be of any suitable form including, for example, a plurality of teeth, or an impeller, or blades, and the like, arranged about the central axis of the rotor.

In certain embodiments, the fixed component or compartment is a stator of cylindrical shape which has a diameter greater than the radial extent of the mixing means such that as the mixing means rotates about a central axis of the rotor there is a gap between the extremity of the mixing means and inner surface of the stator, sometimes referred to as a close-clearance gap. With reference to FIG. 1, which is a schematic depiction (in plan view) of an exemplary rotor/stator configuration, the radius, $R_1$, of the stator (1) is greater than the radial extent of the rotor blades (3) placed about a central axis of rotation (5) of the rotor (7), creating a gap (9). The gap is sufficiently small such that a high shear zone is formed in which microfibrillated cellulose is subjected to further shear which is sufficiently high to modify, for example, to improve, the paper burst strength enhancing attributes of the microfibrillated cellulose. In certain embodiments, the gap is less than about 1 mm, for, example, less than about 0.9 mm, or less than about 0.8 mm, or less than about 0.7 mm, or less than about 0.6 mm, or less than about 0.5 mm. The gap may be greater than about 0.1 mm. Shear is the speed difference between the stator and rotor divided by the size of the gap between the stator and rotor.

Thus, in certain embodiments, the process for modifying, for example, improving, the paper burst strength enhancing attributes of microfibrillated cellulose comprises subjecting said aqueous suspension comprising microfibrillated cellulose and optionally inorganic particulate material to high (mechanical) shear in a high shear mixing apparatus in which the shear is generated, at least in part, by said moving shearing element to modify the paper burst strength enhancing attributes of the microfibrillated cellulose. In certain embodiments, the high shear mixing apparatus is a high shear rotor/stator mixing apparatus.

Figure 2:
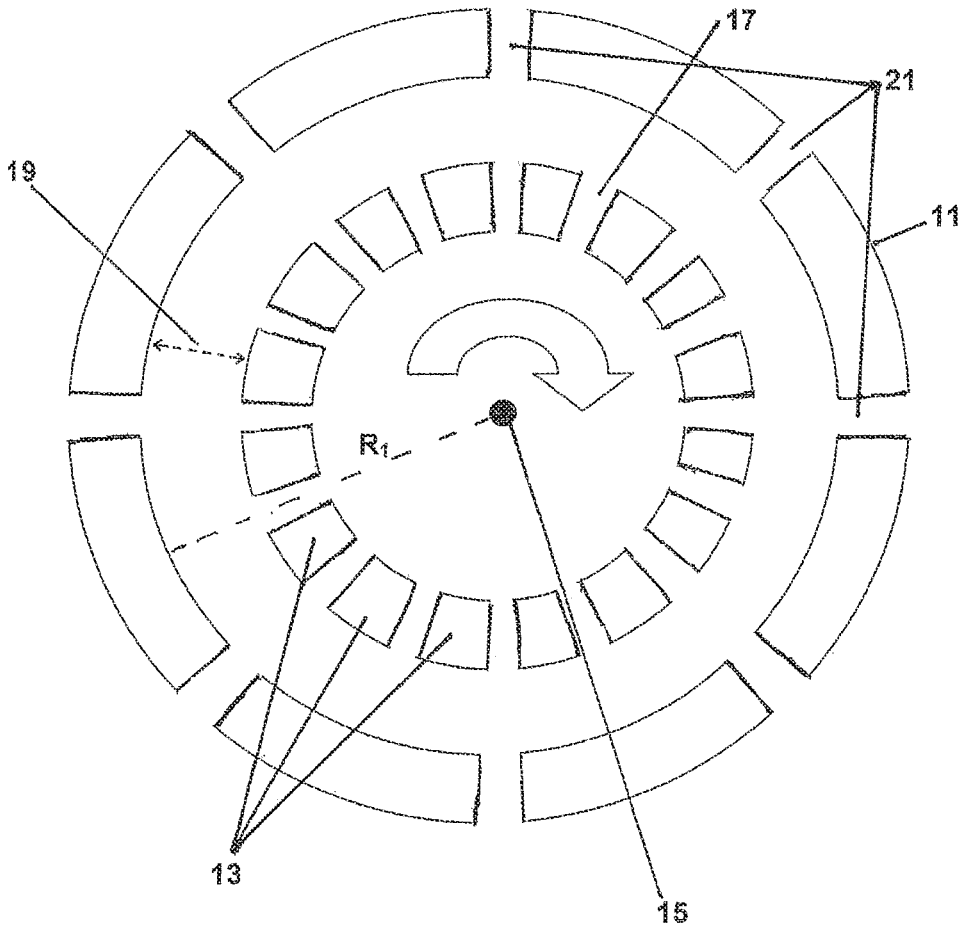
FIG. 2 is a schematic depiction, in plan view, of another rotor/stator configuration suitable for use in the present invention.

In certain embodiments, a further shearing event is created by use of a stator having a series of perforations, e.g., machined holes, slots or notches, about its cylindrical extent, through which the aqueous suspension comprising microfibrillated cellulose is forced by the action of the rotor and mixing means. Another rotor/stator arrangement is depicted (in plan view) in FIG. 2. In this configuration, the rotor (17) has as mixing means a plurality of teeth (13) arranged about the central axis (15) of the rotor. The stator (11) has a series of notches (21) about it cylindrical extent. Again, the radial extent, $R_1$, of the stator (11) is greater than the radial extent of the plurality of teeth (13), creating a gap (19).

Suitable high shear mixing apparatus are many and various, including, but not limited to, batch high shear mixers, inline high shear mixers, and ultra-high-shear inline mixers. An exemplary high shear mixing apparatus is a Silverson®

High Shear In-Line Mixer, manufactured by Silverson®. Other exemplary rotor/stator configurations include those manufactured by Kinematica® AG, such as those marketed under the MEGATRON® brand, and a Kady mill, manufactured by Kady International. Yet another exemplary high shear mixing apparatus is a supermasscolloider that has a moving mechanical part with a complimentary fixed part to generate shear, wherein either the moving mechanical part or the complimentary fixed part has only one aperture.

In certain embodiments, the high speed rotation of the rotor exerts a powerful suction, which draws the feed aqueous suspension comprising microfibrillated cellulose into the fixed compartment, e.g., stator. As the sheared material is withdrawn from the stator, for example, forced out through the holes, slots or notches about the cylindrical extent of the stator, fresh feed material is drawn up, optionally continually, into the stator, maintaining the mixing cycle.

The aqueous suspension comprising microfibrillated cellulose may be subjected to high shear for a period of time and/or total energy input sufficient to modify, for example, improve, the paper burst strength enhancing attributes of the microfibrillated cellulose, or any other of the paper property enhancing attributes described herein. In certain embodiments, the period of time is from about 30 seconds to about 10, for example, from about 30 seconds to about 8 hours, or from about 30 seconds to about 5 hours, or from about 30 seconds to about 4 hours, or from about 30 seconds to about 3 hours, or from about 30 seconds to about 2 hours, or from about 1 minute to about 2 hours, or from about 5 minutes to about 2 hours, or from about 10 minutes to about 2 hours, or from about 15 minutes to about 2 hours, or from about 20 minutes to about 100 minutes, or from about 25 minutes to about 90 minutes, or from about 30 minutes to about 90 minutes, or from about 35 minutes to about 90 minutes, or from about 40 minutes to about 90 minutes, or from about 45 minutes to about 90 minutes.

In certain embodiments, the total energy input is from about 1 kWh/tonne (kWh/t) to about 10,000 kWh/t, based on the total dry weight of cellulosic material in the aqueous suspension comprising microfibrillated cellulose and optional inorganic particulate material, for example, from about 50 kWh/t to about 9,000 kWh/t, or from about 100 kWh/t to about 8,000 kWh/t, or from about 100 kWh/t to about 8,000 kWh/t, or from about 100 kWh/t to about 7,000 kWh/t, or from about 100 kWh/t to about 6,000 kWh/t, or from about 500 kWh/t to about 5,000 kWh/t, or from about 1000 kWh/t to about 5,000 kWh/t, or from about 1500 kWh/t to about 5,000 kWh/t, or from about 2000 kWh/t to about 5,000 kWh/t.

In certain embodiments the total energy input is from about 100 kWh/t to about 5,000 kWh/t.

The total energy input during the high shear process E, may be calculated as:

$$E=P/W \tag{1}$$

wherein E is the total energy input per tonne (kWh/t) of cellulosic material in the aqueous suspension comprising microfibrillated cellulose, P is the total energy input (kWh) and W is the total dry weight of cellulosic material (in tonnes).

In certain embodiments, the microfibrillated cellulose is subjected to high shear in more than one stage, e.g., in multiple (i.e., two or more) passes through the high shear mixing apparatus. For example, the aqueous suspension may be subjected to high shear in accordance with the process described above for a first period of time, passed to an intermediate zone, such as a mixing tank, operating under conditions in which the microfibrillated cellulose is not subjected to shear, and then subjected to high shear for a second period of time, and so on. In certain embodiments, the process is a continuous process in which a feed of said aqueous suspension comprising microfibrillated cellulose is continually fed, e.g., from a mixing tank, to a high shear mixing apparatus, subjected to high shear, drawn from the high shear mixing apparatus and recycled back to the mixing tank, and then recirculated to the high shear mixing apparatus, and so on. A product comprising microfibrillated cellulose having modified, for example, Improved, paper burst strength enhancing attributes, may be withdrawn from the process at any stage, for example, via a product withdrawal point, such as, for example, a drain valve located between the mixing tank and high shear mixing apparatus. Typically, the aqueous suspension comprising microfibrillated cellulose is circulated at a constant flow, and the product is withdrawn periodically, for example, at a time of internal of 5 minutes, and/or 10, minutes, and/or 15 minutes, and/or 20 minutes, and/or 25 minutes, and/or 30 minutes, and/or 35 minutes, and/or 40 minutes, and/or 45 minutes, and/or 50 minutes, and/or 55 minutes, and/or 60 minutes, and/or 65 minutes, and/or 70 minutes, and/or 75 minutes, and/or 80 minutes, and/or 90 minutes, and/or 100 minutes, and/or 110 minutes, and/or 120 minutes.

In certain embodiments, the high shear treatment may be performed in a cascade of high shear devices, for example, a cascade of high shear rotor/stator mixing apparatus, for example, two or three or four or five or six or seven or eight or nine or ten high shear rotor/stator mixing apparatus, operatively inked in series or parallel or a combination of series and parallel. The output from and/or the input to one or more of the high shear vessels in the cascade may be subjected to one or more screening steps and/or one or more classification steps.

In certain embodiments, the high shear treatment may be performed in a single high shear device, for example, a single high shear rotor/stator mixing apparatus having a plurality, i.e. at least two, of operatively distinct high shear zones. For example, an suitable high shear rotor/stator mixing apparatus may have a plurality of high shear zones each having its own rotor/stator.

In certain embodiments, the aqueous suspension comprising microfibrillated cellulose and optional inorganic particulate material has a solids content of no greater than about 25 wt. %, based on the total weight of the aqueous suspension, for example, a solids content of from about 0.1 to about 20 wt. %, or from about 0.1 to about 18 wt. %, or from about 2 to about 16 wt. %, or from about 2 to about 14 wt. % solids, or from about 4 to about 12 wt. %, or from about 4 to about 10 wt. %, or from about 5 to about 10 wt. %, or from about 5 to about 9 wt. %, or from about 5 to about 8.5 wt. %. At any stage of the process, additional water may be added to modify the solids content of the aqueous suspension comprising microfibrillated cellulose and option inorganic particulate material.

In certain embodiments, the aqueous suspension comprising microfibrillated cellulose has a fibre solids content of no greater than about 8 wt. %.

The microfibrillated cellulose may be derived from any suitable source. In certain embodiments, the composition comprising microfibrillated cellulose is obtainable by a process comprising microfibrillating a fibrous substrate comprising cellulose in the presence of a grinding medium. The process is advantageously conducted in an aqueous environment.

In certain embodiments, the aqueous suspension comprising microfibrillated cellulose and optional inorganic particulate material is obtainable by a process comprising grinding a fibrous substrate comprising cellulose in the presence of a grinding medium and optionally said inorganic particulate material. In certain embodiments, the aqueous suspension comprises microfibrillated cellulose and inorganic particulate material, and the aqueous suspension is obtainable by a process comprising grinding a fibrous substrate comprising cellulose in the presence of a grinding medium and inorganic particulate material. A suitable process is described in WO-A-2010/131016, the entire contents of which are hereby incorporated by reference.

By "microfibrillating" is meant a process in which microfibrils of cellulose are liberated or partially liberated as individual species or as small aggregates as compared to the fibres of the pre-microfibrillated pup. Typical cellulose fibres (i.e., pre-microfibrillated pulp) suitable for use in papermaking include larger aggregates of hundreds or thousands of individual cellulose fibrils. By microfibrillating the cellulose, particular characteristics and properties, including the characteristics and properties described herein, are imparted to the microfibrillated cellulose and the compositions comprising the microfibrillated cellulose.

In certain embodiments, the microfibrillating is carried out in the presence of grinding medium which acts to promote microfibrillation of the pre-microfibrillated cellulose. In addition, when present, the inorganic particulate material may act as a microfibrillating agent, i.e., the cellulose starting material can be microfibrillated at relatively lower energy input when it is co-processed, e.g., co-ground, in the presence of an inorganic particulate material. In certain embodiments, the microfibrillating is carried out by other processes known in the art, including processes that are not carried out in the presence of grinding medium.

The fibrous substrate comprising cellulose may be derived from any suitable source, such as wood, grasses (e.g., sugarcane, bamboo) or rags (e.g., textile waste, cotton, hemp or flax). The fibrous substrate comprising cellulose may be in the form of a pulp (i.e., a suspension of cellulose fibres in water), which may be prepared by any suitable chemical or mechanical treatment, or combination thereof. For example, the pulp may be a chemical pulp, or a chemithermomechanical pulp, or a mechanical pulp, or a recycled pulp, or a papermill broke, or a papermill waste stream, or waste from a papermill, or a combination thereof. The cellulose pulp may be beaten (for example in a Valley beater) and/or otherwise refined (for example, processing in a conical or plate refiner) to any predetermined freeness, reported in the art as Canadian standard freeness (CSF) in $cm^3$. CSF means a value for the freeness or drainage rate of pulp measured by the rate that a suspension of pulp may be drained. For example, the cellulose pulp may have a Canadian standard freeness of about 10 $cm^3$ or greater prior to being microfibrillated. The cellulose pulp may have a CSF of about 700 $cm^3$ or less, for example, equal to or less than about 650 $cm^3$, or equal to or less than about 600 $cm^3$, or equal to or less than about 550 $cm^3$, or equal to or less than about 500 $cm^9$, or equal to or less than about 450 $cm^3$, or equal to or less than about 400 $cm^3$, or equal to or less than about 350 $cm^3$, or equal to or less than about 300 $cm^3$, or equal to or less than about 250 $cm^3$, or equal to or less than about 200 $cm^3$, or equal to or less than about 150 $cm^3$, or equal to or less than about 100 $cm^3$, or equal to or less than about 50 $cm^3$. The cellulose pulp may then be dewatered by methods well known in the art, for example, the pulp may be filtered through a screen in order to obtain a wet sheet comprising at least about 10% solids, for example at least about 15% solids, or at least about 20% solids, or at least about 30% solids, or at least about 40% solids. The pulp may be utilised in an unrefined state, that is to say without being beaten or dewatered, or otherwise refined.

The fibrous substrate comprising cellulose may be added to a grinding vessel in a dry state. For example, a dry paper broke may be added directly to the grinder vessel. The aqueous environment in the grinder vessel will then facilitate the formation of a pulp.

The step of microfibrillating may be carried out in any suitable apparatus, including but not limited to a refiner. In one embodiment, the microfibrillating step is conducted in a grinding vessel under wet-grinding conditions. In another embodiment, the microfibrillating step is carried out in a homogenizer.

Wet-Grinding

The grinding is an attrition grinding process in the presence of a particulate grinding medium. By grinding medium is meant a medium other than the inorganic particulate material which is optionally co-ground with the fibrous substrate comprising cellulose. It will be understood that the grinding medium is removed after the completion of grinding.

In certain embodiments, the microfibrillating process, e.g., grinding, is carried out in the absence of grindable inorganic particulate material.

The particulate grinding medium may be of a natural or a synthetic material. The grinding medium may, for example, comprise balls, beads or pellets of any hard mineral, ceramic or metallic material. Such materials may include, for example, alumina, zirconia, zirconium silicate, aluminium silicate, mullite, or the mullite-rich material which is produced by calcining kaolinitic clay at a temperature in the range of from about 1300° C. to about 1800° C.

In certain embodiment, the particulate grinding medium comprises particles having an average diameter in the range of from about 0.1 mm to about 6.0 mm and, more preferably, in the range of from about 0.2 mm to about 4.0 mm. The grinding medium (or media) may be present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge. In certain embodiments, the grinding medium is present in an amount from about 30 to about 70% by volume of the charged, for example, from about 40 to about 60% by volume of the charge, for example, from about 45 to about 55% by volume of the charge.

By 'charge' is meant the composition which is the feed fed to the grinder vessel. The charge includes water, grinding media, fibrous substrate comprising cellulose and inorganic particulate material, and any other optional additives as described herein.

In certain embodiments, the grinding medium is a media comprising particles having an average diameter in the range of from about 0.5 mm to about 12 mm, for example, from about 1 to about 9 mm, or from about 1 mm to about 6 mm, or about 1 mm, or about 2 mm, or about 3 mm, or about 4 mm, or about 5 mm.

The grinding media may have a specific gravity of at least about 2.5, for example, at least about 3, or at least about 3.5, or at least about 4.0, or at least about 4.5, or least about 5.0, or at least about 5.5, or at least about 6.0.

In certain embodiments, the grinding media comprises particles having an average diameter in the range of from about 1 mm to about 6 mm and has a specific gravity of at least about 2.5.

In certain embodiments, the grinding media comprises particles having an average diameter of about 3 mm.

In one embodiment, the mean particle size ($d_{50}$) of the inorganic particulate material is reduced during the co-grinding process. For example, the $d_{50}$ of the inorganic particulate material may be reduced by at least about 10% (as measured by the well known conventional method employed in the art of laser light scattering, using a Malvern Mastersizer S machine), for example, the $d_{50}$ of the inorganic particulate material may be reduced by at least about 20%, or reduced by at least about 30%, or reduced by at least about 50%, or reduced by at least about 50%, or reduced by at least about 60%, or reduced by at least about 70%, or reduced by at least about 80%, or reduced by at least about 90%. For example, an inorganic particulate material having a $d_{50}$ of 2.5 μm prior to co-grinding and a $d_{50}$ of 1.5 μm post co-grinding will have been subject to a 40% reduction in particle size. In certain embodiments, the mean particle size of the inorganic particulate material is not significantly reduced during the co-grinding process. By 'not significantly reduced' is meant that the $d_{50}$ of the inorganic particulate material is reduced by less than about 10%, for example, the $d_{50}$ of the inorganic particulate material is reduced by less than about 5% during the co-grinding process.

The fibrous substrate comprising cellulose may be microfibrillated to obtain microfibrillated cellulose having a do ranging from about 5 to μm about 500 μm, as measured by laser light scattering. The fibrous substrate comprising cellulose may be microfibrillated to obtain microfibrillated cellulose having a $d_{50}$ of equal to or less than about 400 μm, for example equal to or less than about 300 μm, or equal to or less than about 200 μm, or equal to or less than about 150 μm, or equal to or less than about 125 μm, or equal to or less than about 100 μm, or equal to or less than about 90 μm, or equal to or less than about 80 μm, or equal to or less than about 70 μm, or equal to or less than about 60 μm, or equal to or less than about 50 μm, or equal to or less than about 40 μm, or equal to or less than about 30 μm, or equal to or less than about 20 μm, or equal to or less than about 10 μm.

In certain embodiments, the microfibrillated cellulose of the aqueous suspension has, prior to being subjected to high shear, a fibre $d_{50}$ of at least about 50 μm, for example, at least about 75 μm, or at least about 100 μm, or at least about 110 μm, or at least about 120 μm, or at least about 130 μm, or at least about 140 μm, or at least about 150 μm. In certain embodiments, the microfibrillated cellulose of the aqueous suspension has, prior to being subjected to high shear, a fibre do of from about 100 μm to about 160 μm, for example, from about 120 μm to about 160 μm. Generally, during the high shear process, the fibre $d_{50}$ of the microfibrillated cellulose will decrease, for example, decrease by at least about 1%, or at least about 5%, or at least about 10%, or at least about 20%, or at least about 30%, or at least about 40%, or at least about 50%. For example, microfibrillated cellulose having a fibre $d_{50}$ of 120 μm prior to high shear and a fibre do of 108 μm following high shear would be said to have been subject to a 10% reduction in fibre $d_{50}$.

The fibrous substrate comprising cellulose may be microfibrillated in the presence of an inorganic particulate material to obtain microfibrillated cellulose having a fibre steepness equal to or greater than about 10, as measured by Malvern. Fibre steepness (i.e., the steepness of the particle size distribution of the fibres) is determined by the following formula:

$$\text{Steepness}=100\times(d_{30}/d_{70})$$

The microfibrillated cellulose may have a fibre steepness equal to or less than about 100. The microfibrillated cellulose may have a fibre steepness equal to or less than about 75, or equal to or less than about 50, or equal to or less than about 40, or equal to or less than about 30. The microfibrillated cellulose may have a fibre steepness from about 20 to about 50, or from about 25 to about 40, or from about 25 to about 35, or from about 30 to about 40.

In certain embodiments, the microfibrillated cellulose of the aqueous suspension comprising has a fibre steepness of from about 20 to about 50.

Procedures to determine the particle size distributions of minerals and microfibrillated cellulose are described in WO-A-2010/131016. Specifically, suitable procedures are described at page 40. line 32 to page 41, line 34 of WO-A-2010/131016.

The grinding may be performed in a vertical mill or a horizontal mill.

In certain embodiments, the grinding is performed in a grinding vessel, such as a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In one embodiment, the grinding vessel is a vertical mill, for example, a stirred mill, or a stirred media detritor, or a tower mill.

The vertical mill may comprise a screen above one or more grind zones. In an embodiment, a screen is located adjacent to a quiescent zone and/or a classifier. The screen may be sized to separate grinding media from the product aqueous suspension comprising microfibrillated cellulose and inorganic particulate material and to enhance grinding media sedimentation.

In another embodiment, the grinding is performed in a screened grinder, for example, a stirred media detritor. The screened grinder may comprise one or more screen(s) sized to separate grinding media from the product aqueous suspension comprising microfibrillated cellulose and inorganic particulate material.

In certain embodiments, the fibrous substrate comprising cellulose and inorganic particulate material are present in the aqueous environment at an initial solids content of at least about 4 wt %, of which at least about 2% by weight is fibrous substrate comprising cellulose. The initial solids content may be at least about 10 wt %, or at least about 20 wt %, or at least about 30 wt %, or at least about at least 40 wt %. At least about 5% by weight of the initial solids content may be fibrous substrate comprising cellulose, for example, at least about 10%, or at least about 15%, or at least about 20% by weight of the initial solids content may be fibrous substrate comprising cellulose. Generally, the relative amounts of fibrous substrate comprising cellulose and inorganic particulate material are selected in order to obtain a composition comprising microfibrillated cellulose and inorganic particulate according to the first aspect of the invention.

The grinding process may include a pre-grinding step in which coarse inorganic particulate is ground in a grinder vessel to a predetermined particle size distribution, after which fibrous material comprising cellulose is combined with the pre-ground inorganic particulate material and the grinding continued in the same or different grinding vessel until the desired level of microfibrillation has been obtained.

As the suspension of material to be ground may be of a relatively high viscosity, a suitable dispersing agent may be added to the suspension prior to or during grinding. The dispersing agent may be, for example, a water soluble condensed phosphate, polysilicic acid or a salt thereof, or a polyelectrolyte, for example a water soluble salt of a poly (acrylic acid) or of a poly(methacrylic acid) having a number average molecular weight not greater than 80,000. The amount of the dispersing agent used would generally be in the range of from 0.1 to 2.0% by weight, based on the weight of the dry inorganic particulate solid material. The suspension may suitably be ground at a temperature in the range of from 4° C. to 100° C.

Other additives which may be included during the microfibrillation step include: carboxymethyl cellulose, amphoteric carboxymethyl cellulose, oxidising agents, 2,2,6,6-Tetramethylpiperidine-1-oxyl (TEMPO), TEMPO derivatives, and wood degrading enzymes.

When present, the amount of inorganic particulate material and cellulose pulp in the mixture to be co-ground may vary in a ratio of from about 99.5:0.5 to about 0.5:99.5, based on the dry weight of inorganic particulate material and the amount of dry fibre in the pulp, for example, a ratio of from about 99.5:0.5 to about 50:50 based on the dry weight of inorganic particulate material and the amount of dry fibre in the pulp. For example, the ratio of the amount of inorganic particulate material and dry fibre may be from about 99.5:0.5 to about 70:30. In certain embodiments, the weight ratio of inorganic particulate material to dry fibre is about 95:5. In another embodiment, the weight ratio of inorganic particulate material to dry fibre is about 90:10. In another embodiment, the weight ratio of inorganic particulate material to dry fibre is about 85:15. In another embodiment, the weight ratio of inorganic particulate material to dry fibre is about 80:20.

In an exemplary microfibrillation process, the total energy input per tonne of dry fibre in the fibrous substrate comprising cellulose will be less than about 10,000 $kWht^{-1}$, for example, less than about 9000 $kWht^{-1}$, or less than about 8000 $kWht^{-1}$, or less than about 7000 $kWht^{-1}$, or less than about 6000 $kWht^{-1}$, or less than about 5000 $kWht^{-1}$, for example less than about 4000 kWht−1, less than about 3000 $kWht^{-1}$, less than about 2000 $kWht^{-1}$, less than about 1500 $kWht^{-1}$, less than about 1200 $kWht^{-1}$, less than about 1000 $kWht^{-1}$, or less than about 800 $kWht^{-1}$. The total energy input varies depending on the amount of dry fibre in the fibrous substrate being microfibrillated, and optionally the speed of grind and the duration of grind.

In certain embodiment, the grinding is performed in a cascade of grinding vessels, one or more of which may comprise one or more grinding zones. For example, the fibrous substrate comprising cellulose may be ground in a cascade of two or more grinding vessels, for example, a cascade of three or more grinding vessels, or a cascade of four or more grinding vessels, or a cascade of five or more grinding vessels, or a cascade of six or more grinding vessels, or a cascade of seven or more grinding vessels, or a cascade of eight or more grinding vessels, or a cascade of nine or more grinding vessels in series, or a cascade comprising up to ten grinding vessels. The cascade of grinding vessels may be operatively inked in series or parallel or a combination of series and parallel. The output from and/or the input to one or more of the grinding vessels in the cascade may be subjected to one or more screening steps and/or one or more classification steps.

In certain embodiments, for example, embodiments in which a steep particle size distribution of the microfibrillated cellulose is produced by microfibrillation of the fibrous substrate comprising cellulose (optionally in the presence of the inorganic particulate material) in a batch process, the resulting (optionally co-processed) microfibrillated cellulose (and optional inorganic particulate material) composition (i.e., microfibrillated cellulose-containing product) having the desired microfibrillated cellulose steepness may be washed out of the microfibrillation apparatus, e.g., grinding vessel, with water or any other suitable liquid.

The inorganic particulate material may, for example, be an alkaline earth metal carbonate or sulphate, such as calcium carbonate, for example, natural calcium carbonate and/or precipitated calcium carbonate, magnesium carbonate, dolomite, gypsum, a hydrous kandite clay such as kaolin, halloysite or ball clay, an anhydrous (calcined) kandite clay such as metakaolin or fully calcined kaolin, talc, mica, perlite or diatomaceous earth, or magnesium hydroxide, or aluminium trihydrate, or combinations thereof.

In certain embodiments, the inorganic particulate material comprises or is calcium carbonate. Hereafter, the invention may tend to be discussed in terms of calcium carbonate, and in relation to aspects where the calcium carbonate is processed and/or treated. The invention should not be construed as being limited to such embodiments.

The particulate calcium carbonate used in the present invention may be obtained from a natural source by grinding. Ground calcium carbonate (GCC) is typically obtained by crushing and then grinding a mineral source such as chalk, marble or limestone, which may be followed by a particle size classification step, in order to obtain a product having the desired degree of fineness. Other techniques such as bleaching, flotation and magnetic separation may also be used to obtain a product having the desired degree of fineness and/or colour. The particulate solid material may be ground autogenously, i.e. by attrition between the particles of the solid material themselves, or, alternatively, in the presence of a particulate grinding medium comprising particles of a different material from the calcium carbonate to be ground. These processes may be carried out with or without the presence of a dispersant and biocides, which may be added at any stage of the process.

Precipitated calcium carbonate (PCC) may be used as the source of particulate calcium carbonate in the present invention, and may be produced by any of the known methods available in the art. TAPPI Monograph Series No 30, "Paper Coating Pigments", pages 34-35 describes the three main commercial processes for preparing precipitated calcium carbonate which is suitable for use in preparing products for use in the paper industry, but may also be used in the practice of the present invention. In all three processes, a calcium carbonate feed material, such as limestone, is first calcined to produce quicklime, and the quicklime is then slaked in water to yield calcium hydroxide or milk of lime. In the first process, the milk of lime is directly carbonated with carbon dioxide gas. This process has the advantage that no by-product is formed, and it is relatively easy to control the properties and purity of the calcium carbonate product. In the second process the milk of lime is contacted with soda ash to produce, by double decomposition, a precipitate of calcium carbonate and a solution of sodium hydroxide. The sodium hydroxide may be substantially completely separated from the calcium carbonate if this process is used commercially. In the third main commercial process the milk of lime is first contacted with ammonium chloride to give a calcium chloride solution and ammonia gas. The calcium chloride solution is then contacted with soda ash to produce by double decomposition precipitated calcium carbonate and a solution of sodium chloride. The crystals can be produced in a variety of different shapes and sizes, depending on the specific reaction process that is used. The three main forms of PCC crystals are aragonite, rhombohedral and scalenohedral, all of which are suitable for use in the present invention, including mixtures thereof.

Wet grinding of calcium carbonate involves the formation of an aqueous suspension of the calcium carbonate which may then be ground, optionally in the presence of a suitable dispersing agent. Reference may be made to, for example, EP-A-614948 (the contents of which are incorporated by reference in their entirety) for more information regarding the wet grinding of calcium carbonate.

In some circumstances, minor additions of other minerals may be included, for example, one or more of kaolin, calcined kaolin, wollastonite, bauxite, talc or mica, could also be present.

When the inorganic particulate material is obtained from naturally occurring sources, it may be that some mineral impurities will contaminate the ground material. For example, naturally occurring calcium carbonate can be present in association with other minerals. Thus, in some embodiments, the inorganic particulate material includes an amount of impurities. In general, however, the inorganic particulate material used in the invention will contain less than about 5% by weight, preferably less than about 1% by weight, of other mineral impurities.

The inorganic particulate material may have a particle size distribution such that at least about 10% by weight, for example at least about 20% by weight, for example at least about 30% by weight, for example at least about 40% by weight, for example at least about 50% by weight, for example at least about 60% by weight, for example at least about 70% by weight, for example at least about 80% by weight, for example at least about 90% by weight, for example at least about 95% by weight, or for example about 100% of the particles have an e.s.d of less than 2 μm.

In certain embodiments, at least about 50% by weight of the particles have an e.s.d of less than 2 μm, for example, at least about 55% by weight of the particles have an e.s.d of less than 2 μm, or at least about 60% by weight of the particles have an e.s.d of less than 2 μm.

Unless otherwise stated, particle size properties referred to herein for the inorganic particulate materials are as measured in a well known manner by sedimentation of the particulate material in a fully dispersed condition in an aqueous medium using a Sedigraph 5100 machine as supplied by Micromeritics Instruments Corporation, Norcross, Georgia, USA (web-site: www.micromeritics.com), referred to herein as a "Micromeritics Sedigraph 5100 unit". Such a machine provides measurements and a plot of the cumulative percentage by weight of particles having a size, referred to in the art as the 'equivalent spherical diameter' (e.s.d), less than given e.s.d values. The mean particle size $d_{50}$ is the value determined in this way of the particle e.s.d at which there are 50% by weight of the particles which have an equivalent spherical diameter less than that $d_{50}$ value.

Alternatively, where stated, the particle size properties referred to herein for the inorganic particulate materials are as measured by the well known conventional method employed in the art of laser light scattering, using a Malvern Mastersizer S machine as supplied by Malvern instruments Ltd (or by other methods which give essentially the same result). In the laser light scattering technique, the size of particles in powders, suspensions and emulsions may be measured using the diffraction of a laser beam, based on an application of Mie theory. Such a machine provides measurements and a plot of the cumulative percentage by volume of particles having a size, referred to in the art as the 'equivalent spherical diameter' (e.s.d), less than given e.s.d values. The mean particle size $d_w$ is the value determined in this way of the particle e.s.d at which there are 50% by volume of the particles which have an equivalent spherical diameter less than that $d_5$ value.

Thus, in another embodiment, the inorganic particulate material may have a particle size distribution, as measured by the well known conventional method employed in the art of laser light scattering, such that at least about 10% by volume, for example at least about 20% by volume, for example at least about 30% by volume, for example at least about 40% by volume, for example at least about 50% by volume, for example at least about 60% by volume, for example at least about 70% by volume, for example at least about 80% by volume, for example at least about 90% by volume, for example at least about 95% by volume, or for example about 100% by volume of the particles have an e.s.d of less than 2 μm.

In certain embodiments, at least about 50% by volume of the particles have an e.s.d of less than 2 μm, for example, at least about 55% by volume of the particles have an e.s.d of less than 2 μm, or at least about 60% by volume of the particles have an e.s.d of less than 2 μm Details of the procedure that may be used to characterise the particle size distributions of mixtures of inorganic particle material and microfibrillated cellulose using the well known conventional method employed in the art of laser light scattering are discussed above.

In certain embodiments, the inorganic particulate material is kaolin clay. Hereafter, this section of the specification may tend to be discussed in terms of kaolin, and in relation to aspects where the kaolin is processed and/or treated. The invention should not be construed as being limited to such embodiments. Thus, in some embodiments, kaolin is used in an unprocessed form.

Kaolin clay used in this invention may be a processed material derived from a natural source, namely raw natural kaolin clay mineral. The processed kaolin clay may typically contain at least about 50% by weight kaolinite. For example, most commercially processed kaolin clays contain greater than about 75% by weight kaolinite and may contain greater than about 90%, in some cases greater than about 95% by weight of kaolinite.

Kaolin clay used in the present invention may be prepared from the raw natural kaolin clay mineral by one or more other processes which are well known to those skilled in the art, for example by known refining or beneficiation steps.

For example, the clay mineral may be bleached with a reductive bleaching agent, such as sodium hydrosulfite. If sodium hydrosulfite is used, the bleached clay mineral may optionally be dewatered, and optionally washed and again optionally dewatered, after the sodium hydrosulfite bleaching step.

The clay mineral may be treated to remove impurities, e.g. by flocculation, flotation, or magnetic separation techniques well known in the art. Alternatively the clay mineral used in the first aspect of the invention may be untreated in the form of a solid or as an aqueous suspension.

The process for preparing the particulate kaolin clay used in the present invention may also include one or more comminution steps, e.g., grinding or milling. Light comminution of a coarse kaolin is used to give suitable delamination thereof. The comminution may be carried out by use of beads or granules of a plastic (e.g. nylon), sand or ceramic grinding or milling aid. The coarse kaolin may be refined to remove impurities and improve physical properties using well known procedures. The kaolin clay may be treated by a known particle size classification procedure, e.g., screening and centrifuging (or both), to obtain particles having a desired $d_{50}$ value or particle size distribution.

In certain embodiments, the product withdrawn from the high shear process is treated to remove at least a portion or substantially all of the water to form a partially dried or essentially completely dried product. For example, at least about 10% by volume, for example, at least about 20% by volume, or at least about 30% by volume, or least about 40% by volume, or at least about 50% by volume, or at least about 60% by volume, or at least about 70% by volume or at least about 80% by volume or at least about 90% by volume, or at least about 100% by volume of water in product of the co-grinding process may be removed. Any suitable technique can be used to remove water from the product including, for example, by gravity or vacuum-assisted drainage, with or without pressing, or by evaporation, or by filtration, or by a combination of these techniques. The partially dried or essentially completely dried product will comprise microfibrillated cellulose and, when present, inorganic particulate material and any other optional additives that may have been added prior to drying. The partially dried or essentially completely dried product may be optionally re-hydrated and incorporated in papermaking compositions and paper products, as described herein.

As discussed above, the microfibrillated cellulose obtained by the process according to WO-A-2010/131016 has been found to have advantageous paper burst strength enhancing attributes. However, the present inventors have found that paper burst strength enhancing attributes of microfibrillated cellulose can not be further improved by further grinding alone. In this respect, and not wishing to be bound by theory, it appears an equilibrium point is reached in the grinding process beyond which, regardless of the amount of additional energy applied through grinding, the paper burst strength enhancing attributes of the microfibrillated cellulose can not be further improved. The present inventors have unexpectedly found, however, that by subjecting microfibrillated cellulose, such as that obtained by the grinding process described in WO-A-2010/131016, to a high shear treatment, in accordance with the first aspect described above, on or more paper property enhancing attributes of the microfibrillated cellulose, e.g., the paper burst strength enhancing attributes of the microfibrillated cellulose, may be improved. In other words, paper comprising the microfibrillated cellulose obtainable by the high shear process described herein has been found to have an improved paper property or properties (e.g., burst strength) relative to a paper comprising an equivalent amount of the microfibrillated cellulose, which has not been subjected to the high shear process described herein, such as the microfibrillated cellulose obtained by the grinding process described in WO-A-2010/131016.

Paper burst strength may be determined using a Messemer Buchnel burst tester according to SCAN P24. Further details are provided in the Examples below.

As described above, a paper made purely from a fibrous pulp will have a higher paper burst strength than a comparable paper in which a portion of the fibrous pulp has been replaced by a filler, for example, a mineral filler. Thus, the paper burst strength of a filled paper is usually expressed as a percentage of the paper burst strength of the unfilled paper. When used as a filler in paper, for example, as a replacement or partial replacement for a conventional mineral filler, the microfibrillated cellulose obtained by the process described in WO-A-2010/131016, optionally in combination with inorganic particulate material, was unexpectedly found to improve the burst strength properties of the paper. That is, relative to a paper filled with exclusively mineral filler, paper filled with the microfibrillated cellulose was found to have improved burst strength. In other words, the microfibrillated cellulose filler was found to have paper burst strength enhancing attributes.

In certain embodiments, the paper burst strength enhancing attributes of the microfibrillated cellulose obtained by the high shear process described herein is increased by at least about 1%, for example, at least about 5%, or at least about 10% compared to the paper burst strength enhancing attributes of the microfibrillated cellulose prior to the high shear treatment. In other words, in certain embodiments, paper comprising the microfibrillated cellulose obtainable by the high shear process described herein has a paper burst strength which is greater than the paper burst strength of a comparable paper comprising an equivalent amount of microfibrillated cellulose, such as microfibrillated cellulose obtained by the grinding process described in WO-A-2010/131016, which has not been subjected to the high shear process described herein, for example, a paper burst strength which is at least about 1% greater, or at least about 5% greater, or at least about 10% greater.

In certain embodiments, a paper product comprising the microfibrillated cellulose obtained by the high shear process described herein exhibits, either additionally or alternatively, one or more advantageous properties other than improved paper burst strength. For example, paper comprising the microfibrillated cellulose obtained by the high shear process described herein may exhibit improved burst index, or improved tensile strength (e.g., machine direction tensile index), or improved tear strength (e.g., cross direction tear index), or improved z-direction (internal bond) strength (also known as Scott bond strength), or improved (reduced) porosity (e.g., Bendsten porosity), or improved smoothness (e.g., Bendsten smoothness), or improved opacity, or any combination thereof.

In an embodiment, burst index is determined using an L&W Bursting Strength tester based upon TAPPI method T 403 om-91. In certain embodiments, a paper product comprising the microfibrillated cellulose obtainable by the high shear process described herein has a burst index which is greater than the burst index of a comparable paper comprising an equivalent amount of microfibrillated cellulose, such as microfibrillated cellulose obtained by the grinding process described in WO-A-2010/131016, which has not been subjected to the high shear process described herein, for example, a burst index which is at least about 1% greater, or at least about 5% greater, or at least about 10% greater. In certain embodiments, a paper product comprising the microfibrillated cellulose obtainable by the high shear process described herein has a burst index of at least about 1.25 kPa $m^2$ $g^{-1}$, for example, at least about 1.30 kPa $m^2$ $g^{-1}$, or at least about 1.32 kPa $m^2$ $g^{-1}$, or at least about 1.34 kPa $m^2$ $g^{-1}$, or at least about 1.36 kPa $m^2$ $g^{-1}$, for example, from about 1.25 kPa $m^2$ $g^{-1}$ to about 1.50 kPa $m^2$ $g^{-1}$, or from about 1.25 kPa $m^2$ $g^{-1}$ to about 1.45 kPa $m^2$ $g^{-1}$, or from about 1.25 kPa $m^2$ $g^{-1}$ to about 1.40 kPa $m^2$ $g^{-1}$, or from about 1.30 kPa $m^2$ $g^{-1}$ to about 1.40 kPa $m^2$ $g^{-1}$, or from about 1.32 kPa $m^2$ $g^{-1}$ to about 1.40 kPa $m^2$ $g^{-1}$, or from about 1.34 kPa $m^2$ $g^{-1}$ to about 1.38 kPa $m^2$ $g^{-1}$.

In an embodiment, tensile strength (e.g., machine direction tensile index) is determined using a Testometrics tensile tester according to SCAN P16. In certain embodiments, a paper product comprising the microfibrillated cellulose obtainable by the high shear process described herein has a tensile strength which is greater than the tensile strength of a comparable paper comprising an equivalent amount of microfibrillated cellulose, such as microfibrillated cellulose obtained by the grinding process described in WO-A-2010/131016, which has not been subjected to the high shear process described herein, for example, a tensile strength which is at least about 1% greater, or at least about 5% greater, or at least about 10% greater. In certain embodiments, a paper product comprising the microfibrillated cellulose obtainable by the high shear process described herein has a machine direction tensile index of at least about 31.5 Nm $g^{-1}$, for example, at least about 32.0 Nm $g^{-1}$, or at least about 32.5 Nm $g^{-1}$, or at least about 33.0 Nm $g^{-1}$, or from about 32.0 Nm $g^{-1}$ to about 50.0 Nm $g^{-1}$, or from about 32.0 Nm $g^{-1}$ to about 45 Nm $g^{-1}$, or from about 32.0 Nm $g^{-1}$ to about 45 Nm $g^{-1}$, or from about 32.0 Nm $g^{-1}$ to about 40 Nm $g^{-1}$, or from about 32.0 Nm $g^{-1}$ to about 35 Nm $g^{-1}$, or from about 33.0 Nm $g^{-1}$ to about 35 Nm $g^{-1}$.

In an embodiment, cross direction tear strength index is determined in accordance with TAPPI method T 414 om-04 (Internal tearing resistance of paper (Elmendorf-type method). In certain embodiments, a paper product comprising the microfibrillated cellulose obtainable by the high shear process described herein has a tear strength index which is greater than the tear strength index of a comparable paper comprising an equivalent amount of microfibrillated cellulose, such as microfibrillated cellulose obtained by the grinding process described in WO-A-2010/131016, which has not been subjected to the high shear process described herein, for example, a tear strength index which is at least about 1% greater, or at least about 5% greater, or at least about 10% greater. In certain embodiments, a paper product comprising the microfibrillated cellulose obtainable by the high shear process described herein has a tear strength index of at least about 5.45 mN $m^2$ $g^{-1}$, for example, at least about 5.50 mN $m^2$ $g^{-1}$, or at least about 5.60 mN $m^2$ $g^{-1}$, or at least about 5.70 mN $m^2$ $g^{-1}$, or at least about 5.80 mN $m^2$ $g^{-1}$, for example, from about 5.45 mN $m^2$ $g^{-1}$ to about 6.50 mN $m^2$ $g^{-1}$, or from about 5.45 mN $m^2$ $g^{-1}$ to about 6.25 mN $m^2$ $g^{-1}$, or from about 5.45 mN $m^2$ $g^{-1}$ to about 6.00 mN $m^2$ $g^{-1}$, or from about 5.55 mN $m^2$ $g^{-1}$ to about 6.00 mN $m^2$ $g^{-1}$, or from about 5.65 mN $m^2$ $g^{-1}$ to about 6.00 mN $m^2$ $g^{-1}$, or from about 5.75 mN $m^2$ $g^{-1}$ to about 6.50 mN $m^2$ $g^{-1}$, or from about 5.80 mN $m^2$ g to about 6.00 mN $m^2$ $g^{-1}$.

In an embodiment, z-direction (internal bond) strength is determined using a Scott bond tester according to TAPPI T569. In certain embodiments, a paper product comprising the microfibrillated cellulose obtainable by the high shear process described herein has a z-direction (Internal (Scott) bond) strength which is greater than the z-direction (internal (Scott) bond) strength of a comparable paper comprising an equivalent amount of microfibrillated cellulose, such as microfibrillated cellulose obtained by the grinding process described in WO-A-2010/131016, which has not been subjected to the high shear process described herein, for example, a z-direction (internal (Scott) bond) strength which is at least about 1% greater, or at least about 5% greater, or at least about 10% greater, or at least about 20% greater, or at least about 30% greater, or at least about 40% greater, or at least about 50% greater. In certain embodiments, a paper product comprising the microfibrillated cellulose obtainable by the high shear process described herein has a z-direction (Internal (Scott) bond) strength of at least about 130.0 J $m^{-2}$, for example, at least about 150.0 J $m^{-2}$, or at least about 170.0 J $m^{-2}$, or at least about 180.0 J $m^{-2}$, or at least about 190.0 J $m^{-2}$, for example, from about 130.0 J $m^2$ to about 250.0 J $m^{-2}$, or from about 130.0 J $m^{-2}$ to about 230.0 J $m^{-2}$, or from about 150.0 J $m^{-2}$, to about 210.0 J $m^{-2}$, or from about 170.0 J $m^{-2}$ to about 210 J $m^{-2}$, or from about 180.0 J $m^{-2}$, to about 210.0 J $m^{-2}$, or from about 190.0 J $m^{-2}$, to about 200.0 J $m^{-2}$.

In an embodiment, porosity is determined using a Bendsten Model 5 porosity tester in accordance with SCAN P21, SCAN P60, BS 4420 and TAPPI UM 535. In certain embodiments, a paper product comprising the microfibrillated cellulose obtainable by the high shear process described herein has a porosity which is lower than the porosity of a comparable paper comprising an equivalent amount of microfibrillated cellulose, such as microfibrillated cellulose obtained by the grinding process described in WO-A-2010/131016, which has not been subjected to the high shear process described herein, for example, a porosity which is at least about 1% lower, or at least about 5% lower, or at least about 10% lower, or at least about 20% lower, or at least about 30% lower, or at least about 40% lower, or at least about 40% lower, or at least about 60% lower, or at least about 70% lower, or at least about 80% lower. In certain embodiments, a paper product comprising the microfibrillated cellulose obtainable by the high shear process described herein has a Bendsten porosity which is less than about 1000 $cm^3$ $min^{-1}$, for example, less than about 950 $cm^3$ $min^{-1}$, or less than about 900 $cm^3$ $min^{-1}$, or less than about 875 $cm^3$ $min^{-1}$, or less than about 850 $cm^3$ $min^{-1}$, or less than about 825 $cm^3$ $min^{-1}$, or less than about 815 $cm^3$ $min^{-1}$, or less than about 805 $cm^3$ $min^{-1}$, for example, from about 700 $cm^3$ $min^{-1}$ to about 1000 $cm^3$ $min^{-1}$, or from about 750 $cm^3$ $min^{-1}$ to about 950 $cm^3$ $min^{-1}$, or from about 750 $cm^3$ $min^{-1}$ to about 900 $cm^3$ $min^{-1}$, or from about 750 $cm^3$ $min^{-1}$ to less than about 850 $cm^3$ $min^{-1}$.

In an embodiment, Bendsten smoothness is determined in accordance with SCAN P 21:67. In certain embodiments, a paper product comprising the microfibrillated cellulose obtainable by the high shear process described herein has a smoothness which is greater than the smoothness of a comparable paper comprising an equivalent amount of microfibrillated cellulose, such as microfibrillated cellulose obtained by the grinding process described in WO-A-2010/131016, which has not been subjected to the high shear process described herein, for example, a smoothness which is at least about 1% greater, or at least about 5% greater, or at least about 10% greater, or at least about 20% greater, or at least about 30% greater. In certain embodiments, a paper product comprising the microfibrillated cellulose obtainable by the high shear process described herein has a Bendsten smoothness of at least about 560 $cm^3$ $min^{-1}$, for example, at least about 580 $cm^3$ $min^{-1}$, or at least about 600 $cm^3$ $min^{-1}$, or at least about 620 $cm^3$ $min^{-1}$, or at least about 640 $cm^3$ $min^{-1}$, or at least about 660 $cm^3$ $min^{-1}$, or at least about 680 $cm^3$ $min^{-1}$, for example, from about 560 $cm^3$ $min^{-1}$ to about 800 $cm^3$ $min^{-1}$, or from about 600 $cm^3$ $min^{-1}$ to about 750 $cm^3$ $min^{-1}$, or from about 640 $cm^3$ $min^{-1}$ to about 725 $cm^3$ $min^{-1}$, or from about 660 $cm^3$ $min^{-1}$ to about 705 $cm^3$ $min^{-1}$.

In an embodiment, opacity of sample of paper (80 $gm^{-2}$) is measured by means of an Elrepho Datacolor 3300 spectrophotometer using a wavelength appropriate to opacity measurement. The standard test method is ISO 2471. First, a measurement of the percentage of the incident light reflected is made with a stack of at least ten sheets of paper over a black cavity (Rinfinity). The stack of sheets is then replaced with a single sheet of paper, and a second measurement of the percentage reflectance of the single sheet on the black cover is made (R). The percentage opacity is then calculated from the formula: Percentage opacity=100× R/Rinfinity. In certain embodiments, a paper product comprising the microfibrillated cellulose obtainable by the high shear process described herein has an opacity which is greater than the opacity of a comparable paper comprising an equivalent amount of microfibrillated cellulose, such as microfibrillated cellulose obtained by the grinding process described in WO-A-2010/131016, which has not been subjected to the high shear process described herein, for example, an opacity which is at least about 0.10% greater, or at least about 0.15% greater, or at least about 0.20% greater, or at least about 0.25% greater, or at least about 0.30% greater.

The, post-high shear product comprising microfibrillated cellulose will typically have a viscosity which is greater than the viscosity of the microfibrillated cellulose prior to high shear treatment, in certain embodiments, the post-high shear product comprising microfibrillated cellulose and optional inorganic particulate material may has a Brookfield viscosity (Spindle No. 4, at 10 rpm, and a fibre content of 1.5 wt. %) of at least about 2,000 MPa·s, for example, of from about 2,500 to about 13,000 MPa·s, or from about 2,500 to about 11,000 MPa·s, or from about 3,000 to about 9,000 MPa·s, or from about 3,000 to about 7,000 MPa·s, or from about 3,500 to about 6,000 MPa·s, or from about 4,000 to about 6,000 MPa·s. Brookfield viscosity is determined in accordance with the following procedure. A sample of the composition, e.g., the post-high shear product is diluted with sufficient water to give a fibre content of 1.5 wt. %. The diluted sample is then mixed well and its viscosity measured using a Brookfield R.V. viscometer (spindle No 4) at 10 rpm. The reading is taken after 15 seconds to allow the sample to stabilise.

Figure 3:
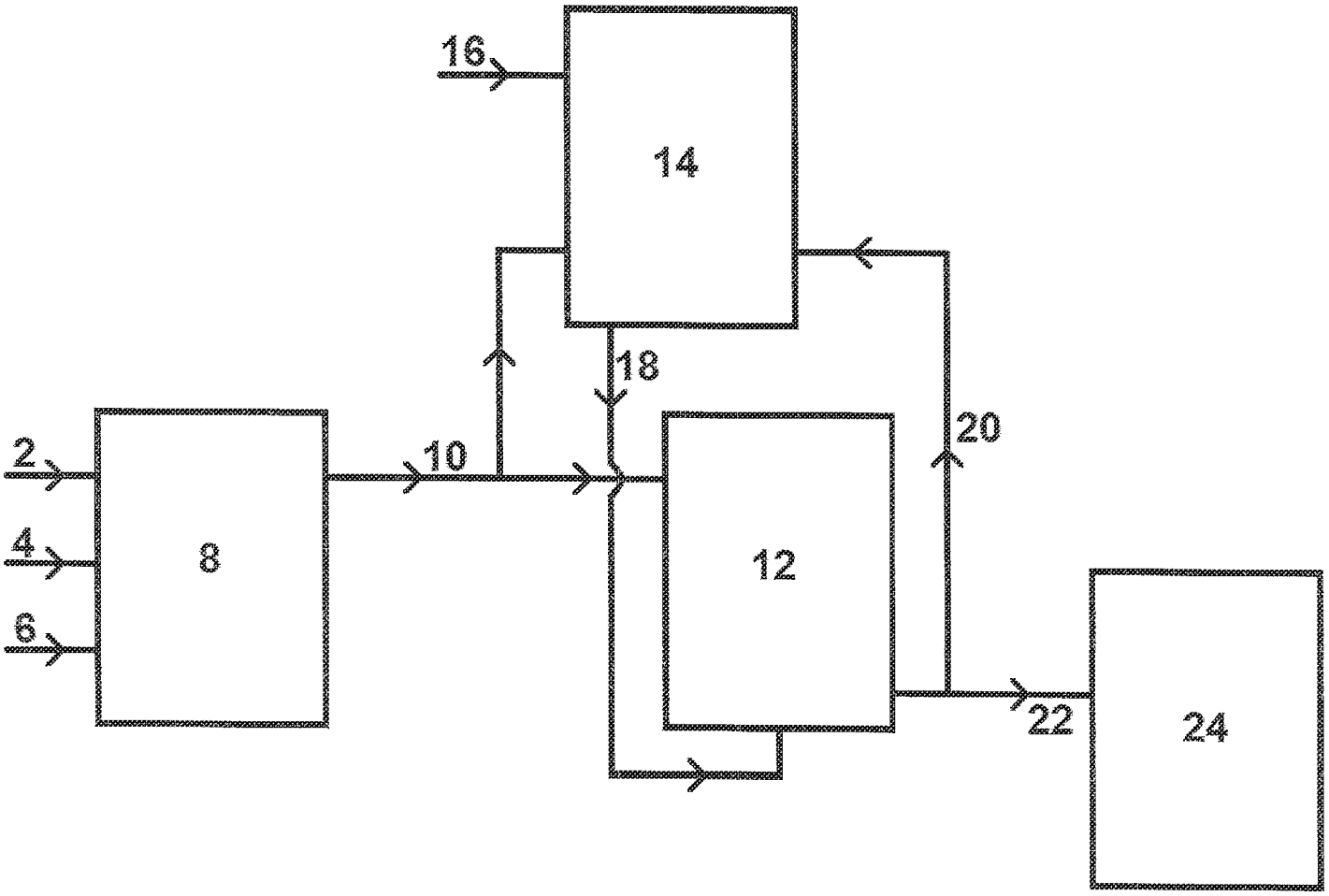
FIG. 3 is a schematic diagram of an integrated process for preparing microfibrillated cellulose having modified, for example, improved, paper burst strength enhancing attributes.

An Integrated process for the preparation of microfibrillated cellulose is summarized in FIG. 3. Water (2), fibre pulp (4), and optional inorganic particulate (6) is fed to a grinding vessel (8), for example, a tower mill or a stirred media detritor, containing a suitable grinding medium (not shown). The fibre pulp is ground in the presence of the grinding medium and optional inorganic particulate material in accordance with the process described below and/or in accordance with the process for preparing microfibrillated cellulose as disclosed in WO-A-2010/131016. The resulting aqueous suspension comprising microfibrillated cellulose (10) and optional inorganic particulate material is then fed to an inline high shear mixer (12). The grinder is fitted with an appropriately sized screen or screens (not shown) to separate grinding media from the aqueous suspension comprising microfibrillated cellulose and optional inorganic particulate material. Optionally, the aqueous suspension, or a portion thereof, may be fed to a mixing tank (14) and combined with additional water (16) to reduce its solids content, producing an aqueous suspension of reduced solids content (18), and then fed to the in-line high shear mixer (12). For example, if the solids content of the aqueous suspension withdrawn from the grinder is greater than about 10% then it may be directed to the mixing tank in order to reduce the solids content to less than 10%. The aqueous suspension comprising microfibrillated cellulose and optional inorganic particulate material is subjected to high shear in the in-line high shear mixer. Periodically, post-high sheared product (20) may be re-circulated to mixing tank (14) for further mixing and optional further dilution. A final post-high sheared product (22) is withdrawn from the in-line high shear mixer (12) and passed to a further processing zone (24). The further processing zone (24) may comprise means (not shown) for incorporating the post-high shear product into a papermaking composition, and means (not shown) for making a paper product from the papermaking composition. The further processing zone (24) may also comprise means (not shown) for coating the paper product.

In certain embodiments, the microfibrillated cellulose, prior to high shear treatment, is prepared in a first location and subjected to high shear in a second location separate, e.g., distant, from the first location. The microfibrillated cellulose prepared in the first location may be transported to the second location by road, rail, ship or air, or piped, or any combination thereof. In certain embodiments, the microfibrillated cellulose prepared in the first location is treated to reduce its water content and optionally combined with further additives, e.g., flocculants, preservatives and/or biocides, and then transported to the second location, where it may be made down to a suitable solids content and subjected to high shear treatment. Further additives include, for example, one or more high molecular mass cationically modified polyacrylamide flocculants, and/or one or more BIT (2-Benzisothiazoline-3-one), CMIT (5-chloro-2-methyl-4-isothiazolin-3-one) and MIT (Methylisothiazolinone) biocides (available from The Dow Chemical Company), DBNPA biocide (available from The Dow Chemical Company), hydrogen peroxide, glutaraldehyde and/or THPS (Tetrakis(hydroxymethyl)phosphonium sulfate). Blends of BIT, MIT and CMIT may be added, e.g., a blend of BIT and MIT, or a blend of CMIT and MIT. For transportation, the microfibrillated cellulose may be in the form of a partially dried or essentially dried product, as described herein. Any suitable technique can be used to remove water from the microfibrillated cellulose product, for example, by gravity or vacuum-assisted drainage, with or without pressing, or by pressing, or by evaporation, or by filtration, or by a combination of these techniques. For example, at the first location, the water content of the microfibrillated cellulose may be reduced to less than about 80% by volume, or less than about 70% by volume, or less than about 60% by volume, or less than about 50% by volume, or less than about 40% by volume, or less than about 30% by volume, or less than about 20% by volume, or less than about 15% by volume, or less than 10% by volume, or less than about 5% by volume, or less than about 2% by volume, or less than about 1% by volume, based on the total volume of water in the microfibrillated cellulose product prior to removal of water, before being transported to the second location. The distance, determined by the mode and route of transport, between the first location and second location may be between about 100 metres and about 10,000 km, for example, between about 1 km and about 7, 500 km, or between about 1 km and about 5,000 km, or at least about 10 km, or at least about 50 km, or at least about 100 km, or at least about 250 km, or at least about 500 km, or at least about 750 km, or at least about 1,000 km.

Paper Products and Papermaking Compositions

The term "paper product", as used in connection with the present invention, should be understood to mean all forms of paper, including board such as, for example, white-lined board and linerboard, cardboard, paperboard, coated board, and the like. There are numerous types of paper, coated or uncoated, which may be made according to the present invention, including paper suitable for books, magazines, newspapers and the like, and office papers. The paper may be calendered or supercalendered as appropriate; for example super calendered magazine paper for rotogravure and offset printing may be made according to the present methods. Paper suitable for light weight coating (LWC), medium weight coating (MWC) or machine finished pigmentisation (MFP) may also be made according to the present methods. Coated paper and board having barrier properties suitable for food packaging and the like may also be made according to the present methods.

In certain embodiments, the paper product comprises from about 0.1 to about 10 wt. % of microfibrillated cellulose which has been subjected to high shear in accordance with the processes described herein, for example, from about 0.1 to about 8.0 wt. % microfibrillated cellulose, or from about 0.1 to about 7.0 wt. % microfibrillated cellulose, or from about 0.1 to about 6.0 wt % microfibrillated cellulose, or from about 0.25 to about 6.0 wt. % microfibrillated cellulose, or from about 0.5 to about 6.0 wt. % microfibrillated cellulose, or from about 1.0 to about 6.0 wt. % microfibrillated cellulose, or from about 1.5 to about 6.0 wt. % microfibrillated cellulose, or from about 2.0 to about 6.0 wt. % microfibrillated cellulose, or from about 2.5 to about 5.5 wt. % microfibrillated cellulose, or from about 2.5 to about 5.0 wt. % microfibrillated cellulose.

In certain embodiments, the paper product comprises from about 1 to about 50% by weight inorganic particulate material, for example, from about 5 to about 45% by weight inorganic particulate material, or from about 10 to about 45% by weight inorganic particulate material, or from about 15 to about 45% by weight inorganic particulate material, or from about 20 to about 45% by weight inorganic particulate material, or from about 25 to about 45% by weight inorganic particulate material, or from about 30 to about 45% by weight inorganic particulate material, or from about 35 to about 45% by weight inorganic particulate material or from about 20 to about 40% by weight inorganic particulate material, or from about 30 to about 50% by weight inorganic particulate material, or from about 30 to about 40% by weight inorganic particulate material, or from about 40 to about 50% by weight inorganic particulate material.

The paper product may comprise other optional additives including, but not limited to, dispersant, biocide, suspending aids, salt(s) and other additives, for example, starch or carboxy methyl cellulose or polymers, which may facilitate the interaction of mineral particles and fibres.

In certain embodiments, the paper product has a paper burst strength which is improved relative to a comparable paper product comprising an equivalent amount of microfibrillated cellulose, such as microfibrillated cellulose obtained by the grinding process described in WO-A-2010/131016, which has not been subjected to the high shear process described herein.

In certain embodiments, the paper product has a burst strength of at least about 85 as determined using a Messemer Buchnel burst tester according to SCAN P24, for example, at least about 86, or at least about 87, or at least about 88, or at least about 89, or at least about 90, or at least about 91, or at least about 92, or at least about 93, or at least about 94, or at least about 95.

Also provided is a papermaking composition which can be used to prepare the paper products of the present invention.

In a typical papermaking process, a cellulose-containing pulp is prepared by any suitable chemical or mechanical treatment, or combination thereof, which are well known in the art. The pulp may be derived from any suitable source such as wood, grasses (e.g., sugarcane, bamboo) or rags (e.g., textile waste, cotton, hemp or flax). The pulp may be bleached in accordance with processes which are well known to those skilled in the art and those processes suitable for use in the present invention will be readily evident. The bleached cellulose pulp may be beaten, refined, or both, to a predetermined freeness (reported in the art as Canadian standard freeness (CSF) in $cm^3$). A suitable paper stock is then prepared from the bleached and beaten pulp.

The papermaking composition of the present invention comprises suitable amounts of pulp, optional inorganic particulate material, and optional other conventional additives known in the art, to obtain a paper product according to the invention therefrom.

The papermaking composition may also contain a non-ionic, cationic or an anionic retention aid or microparticle retention system in an amount in the range from about 0.01 to 2% by weight, based on the weight of the paper product. Generally, the greater the amount of inorganic particulate material, the greater the amount of retention aid. It may also contain a sizing agent which may be, for example, a long chain alkylketene dimer, a wax emulsion or a succinic acid derivative. The papermaking composition may also contain dye and/or an optical brightening agent. The papermaking composition may also comprise dry and wet strength aids such as, for example, starch or epichlorhydrin copolymers.

In certain embodiments, the paper product may be coated with a coating composition.

The coating composition may be a composition which imparts certain qualities to the paper, including weight, surface gloss, smoothness or reduced ink absorbency. For example, a kaolin- or calcium carbonate-containing composition may be used to coat the paper product paper. A coating composition may include binder, for example, styrene-butadiene latexes and natural organic binders such as starch. The coating formulation may also contain other known additives for coating compositions. Exemplary additive are described in WO-A-2010/131016 from page 21, line 15 to page 24, line 2.

In certain embodiments, the coating composition may comprise microfibrillated cellulose obtained by the processes described herein, for example, microfibrillated cellulose obtainable by the process according to the first aspect of the present invention and/or microfibrillated cellulose obtainable by the processes described in WO-A-2010/131016.

Methods of coating paper and other sheet materials, and apparatus for performing the methods, are widely published and well known. Such known methods and apparatus may conveniently be used for preparing coated paper. For example, there is a review of such methods published in Pulp and Paper International, May 1994, page 18 et seq. Sheets may be coated on the sheet forming machine, i.e., "on-machine," or "off-machine" on a coater or coating machine. Use of high solids compositions is desirable in the coating method because it leaves less water to evaporate subsequently. However, as is well known in the art, the solids level should not be so high that high viscosity and leveling problems are introduced. The methods of coating may be performed using an apparatus comprising (i) an application for applying the coating composition to the material to be coated and (ii) a metering device for ensuring that a correct level of coating composition is applied. When an excess of coating composition is applied to the applicator, the metering device is downstream of it. Alternatively, the correct amount of coating composition may be applied to the applicator by the metering device, e.g., as a film press. At the points of coating application and metering, the paper web support ranges from a backing roll, e.g., via one or two applicators, to nothing (i.e., Just tension). The time the coating is in contact with the paper before the excess is finally removed is the dwell time—and this may be short, long or variable.

The coating is usually added by a coating head at a coating station. According to the quality desired, paper grades are uncoated, single-coated, double-coated and even triple-coated. When providing more than one coat, the initial coat (precoat) may have a cheaper formulation and optionally coarser pigment in the coating composition. A coater that is applying coating on each side of the paper will have two or four coating heads, depending on the number of coating layers applied on each side. Most coating heads coat only one side at a time, but some roll coaters (e.g., film presses, gate rolls, and size presses) coat both sides in one pass.

Examples of known coaters which may be employed include, without limitation, air knife coaters, blade coaters, rod coaters, bar coaters, multi-head coaters, roll coaters, roll or blade coaters, cast coaters, laboratory coaters, gravure coaters, kisscoaters, liquid application systems, reverse roll coaters, curtain coaters, spray coaters and extrusion coaters.

Water may be added to the solids comprising the coating composition to give a concentration of solids which is preferably such that, when the composition is coated onto a sheet to a desired target coating weight, the composition has a rheology which is suitable to enable the composition to be coated with a pressure (i.e., a blade pressure) of between 1 and 1.5 bar.

Calendering is a well known process in which paper smoothness and gloss is improved and bulk is reduced by passing a coated paper sheet between calender nips or rollers one or more times. Usually, elastomer-coated rolls are employed to give pressing of high solids compositions. An elevated temperature may be applied. One or more (e.g., up to about 12, or sometimes higher) passes through the nips may be applied. Supercalendering is a paper finishing operation consisting of an additional degree of calendaring. Like calendaring, supercalendering is a well known process. The supercalender gives the paper product a high-gloss finish, the extent of supercalendering determining the extent of the gloss. A typical supercalender machine comprises a vertical alternating stack of hard polished steel and soft cotton (or other resilient material) rolls, for example, elastomer-coated rolls. The hard roll is pressed heavily against the soft roll, compressing the material. As the paper web passes through this nip, the force generated as the soft roll struggles to return to its original dimensions "buffs" the paper, generating the additional luster and enamel-like finish typical of supercalendered paper.

The steps in the formation of a final paper product from a papermaking composition are conventional and well know in the art and generally comprise the formation of paper sheets having a targeted basis weight, depending on the type of paper being made.

For the avoidance of doubt, the present application is directed to the subject-matter described in the following numbered paragraphs:

1. A process for modifying the paper burst strength enhancing attributes of microfibrillated cellulose, said process comprising subjecting an aqueous suspension comprising microfibrillated cellulose and optionally inorganic particulate material to high shear, wherein the high shear is generated, at least in part, by a moving shearing element, to modify the paper burst strength enhancing attributes of the microfibrillated cellulose.

2. A process according to numbered paragraph 1, for improving the paper burst strength enhancing attributes of microfibrillated cellulose, said process comprising subjecting the aqueous suspension comprising microfibrillated cellulose and optionally inorganic particulate material to high shear to improve the paper burst strength enhancing attributes of the microfibrillated cellulose.

3. A process according to any preceding numbered paragraph, wherein the moving shearing element is housed within a high shear rotor/stator mixing apparatus, and the process comprises subjecting the aqueous suspension comprising microfibrillated cellulose to high shear in said rotor/stator mixing apparatus to modify, for example, improve, the paper burst strength enhancing attributes of the microfibrillated cellulose.

4. A process according to any preceding numbered paragraph, wherein the microfibrillated cellulose of the aqueous suspension comprising microfibrillated cellulose has, prior to high shear, a fibre steepness of from about 20 to about 50.

5. A process according to any preceding numbered paragraph, wherein the microfibrillated cellulose of the aqueous suspension comprising microfibrillated cellulose has, prior to high shear, a fibre $d_{50}$ of at least about 50 μm.

6. A process according to any preceding numbered paragraph, further comprising obtaining the aqueous suspension comprising microfibrillated cellulose, optionally wherein the aqueous suspension comprising microfibrillated cellulose is obtained by a processing comprising microfibrillating a fibrous substrate comprising cellulose in an aqueous environment in the presence of a grinding medium, and optionally in the presence of said inorganic particulate material suspension comprising fibrous material and optional inorganic material.

7. A process according to numbered paragraph 6, where said microfibrillating process comprises grinding the fibrous substrate comprising cellulose in the presence of the grinding medium and optional inorganic particulate material.

8. A process according to any preceding numbered paragraph, wherein the inorganic particulate material, when present, is an alkaline earth metal carbonate or sulphate, such as calcium carbonate, for example, natural calcium carbonate and/or precipitated calcium carbonate, magnesium carbonate, dolomite, gypsum, a hydrous kandite clay such as kaolin, halloysite or ball clay, an anhydrous (calcined) kandite clay such as metakaolin or fully calcined kaolin, talc, mica, perlite or diatomaceous earth, or magnesium hydroxide, or aluminium trihydrate, or combinations thereof.

9. A process according to numbered paragraph 8, wherein the inorganic particulate is calcium carbonate, optionally wherein at least about 50 wt. % of the calcium carbonate has an e.s.d. of less than about 2 μm.

10. A process according to numbered paragraph 8, wherein the inorganic particulate material is kaolin, optionally where at least about 50 wt. % of the kaolin has an e.s.d. of less than about 2 μm.

11. A process according to any preceding numbered paragraph, wherein the fibre $d_{50}$ of the microfibrillated cellulose is, following high shear, reduced, for example, reduced by at least about 1%, or at least about 5%, or at least about 10%, or at least about 50%.

12. A process according to any preceding numbered paragraph, wherein, following high shear, the paper burst strength enhancing attributes of the microfibrillated cellulose is increased by at least about 1%, for example, at least about 5%, or at least about 10%.

13. A process according to any preceding numbered paragraph, wherein, following high shear, the microfibrillated cellulose has a Brookfield viscosity (Spindle No. 4, at 10 rpm, and a fibre content of 1.5 wt. %) of at least about 2000 MPa·s.

14. A process according to any preceding numbered paragraph, wherein the process is a batch process or a continuous process.

15. A process according to any preceding numbered paragraph, where the aqueous suspension comprising microfibrillated cellulose is stirred in a mixing tank prior to high shear and/or during the process.

16. A process according to any preceding numbered paragraph, wherein the total energy input during the high shear, E, is calculated as, E=P/W, wherein E is the total energy input per tonne (kWh/t) of cellulosic material in the aqueous suspension comprising microfibrillated cellulose, P is the total energy input (kWh) and W is the total weight of cellulosic material (in tonnes).

17. A process according to any preceding numbered paragraph, further comprising preparing a papermaking composition comprising microfibrillated cellulose, and optionally inorganic particulate material, obtainable by the process of any preceding claim.

18. A process according to numbered paragraph 17, further comprising preparing a paper product from the papermaking composition.

19. An aqueous suspension comprising microfibrillated cellulose, and optionally inorganic particulate material, obtainable by the process of any one of numbered paragraphs 1-16.

20. A papermaking composition obtainable by the process of numbered paragraph 17.

21. A paper product obtainable by the process of numbered paragraph 18, wherein the paper product has a first burst strength which is greater than a second burst strength of a comparable paper product comprising an equivalent amount of microfibrillated cellulose as defined in any one of numbered paragraphs 1, 4 and 5 (prior to high shear).

22. A paper product according to numbered paragraph 21, wherein the paper product comprises from about 0.1 to about 5% by weight microfibrillated cellulose and optionally up to about 50% by weight inorganic particulate material.

For the avoidance of doubt, the present application is directed to the subject-matter described in the following numbered paragraphs:

1a. A process for treating microfibrillated cellulose, said process comprising subjecting an aqueous suspension comprising microfibrillated cellulose and optionally inorganic particulate material to high shear, wherein the high shear is generated, at least in part, by a moving shearing element.

2a. A process according to numbered paragraph 1a, for modifying, for example, improving, one or more paper property enhancing attributes of microfibrillated cellulose, said process comprising subjecting the aqueous suspension comprising microfibrillated cellulose and optionally inorganic particulate material to high shear to modify, for example, improve, a paper property enhancing attribute of the microfibrillated cellulose.

3a. A process according to numbered paragraphs 1a or 2a, wherein the moving shearing element is housed within a high shear rotor/stator mixing apparatus, and the process comprises subjecting the aqueous suspension comprising microfibrillated cellulose to high shear in said rotor/stator mixing apparatus to modify, for example, improve, the one or more paper property enhancing attributes of the microfibrillated cellulose.

4a. A process according to any one of numbered paragraphs 1a to 3a, wherein (i) the microfibrillated cellulose of the aqueous suspension comprising microfibrillated cellulose has, prior to high shear, a fibre steepness of from about 20 to about 50, and/or (ii) the microfibrillated cellulose of the aqueous suspension comprising microfibrillated cellulose has, prior to high shear, a fibre d50 of at least about 50 μm.

5a. A process according to any one of numbered paragraphs 1a to 4a, further comprising obtaining the aqueous suspension comprising microfibrillated cellulose, optionally wherein the aqueous suspension comprising microfibrillated cellulose is obtained by a processing comprising microfibrillating a fibrous substrate comprising cellulose in an aqueous environment in the presence of a grinding medium, and optionally in the presence of said inorganic particulate material suspension comprising fibrous material and optional inorganic material.

6a. A process according to claim 5a, where said microfibrillating process comprises grinding the fibrous substrate comprising cellulose in the presence of the grinding medium and optional inorganic particulate material.

7a. A process according to any one of numbered paragraphs 1a to 6a, wherein the inorganic particulate material, when present, is an alkaline earth metal carbonate or sulphate, such as calcium carbonate, for example, natural calcium carbonate and/or precipitated calcium carbonate, magnesium carbonate, dolomite, gypsum, a hydrous kandite clay such as kaolin, halloysite or ball clay, an anhydrous (calcined) kandite clay such as metakaolin or fully calcined kaolin, talc, mica, perlite or diatomaceous earth, or magnesium hydroxide, or aluminium trihydrate, or combinations thereof.

8a. A process according to numbered paragraph 7a, wherein (i) the inorganic particulate is calcium carbonate, optionally wherein at least about 50 wt. % of the calcium carbonate has an e.s.d. of less than about 2 μm, or (ii) the inorganic particulate material is kaolin, optionally where at least about 50 wt. % of the kaolin has an e.s.d. of less than about 2 μm.

9a. A process according to any one of numbered paragraphs 1a to 7a, wherein the fibre d50 of the microfibrillated cellulose is, following high shear, reduced, for example, reduced by at least about 1%, or at least about 5%, or at least about 10%, or at least about 50%.

10a. A process according to any one of numbered paragraphs 1a to 9a, wherein, following high shear, the:

(i) paper burst strength enhancing attributes of the microfibrillated cellulose is increased by at least about 1%, for example, at least about 5%, or at least about 10%; and/or (ii) paper burst index enhancing attributes of the microfibrillated cellulose is increased by at least about 1%, or at least about 5%, or at least about 10%; and/or (ill) tensile strength enhancing attributes of the microfibrillated cellulose is increased by at least about 1%, or at least about 5%, or at least about 10%, and/or (iv) z-direction (Internal (Scott) bond) strength enhancing attributes of the microfibrillated cellulose is increased by at least about 1%, or at least about 5%, or at least about 10%, or at least about 20%, or at least about 30%, or at least about 40%, or at least about 50%; and/or (v) tear strength enhancing attributes of the microfibrillated cellulose is increased by at least about 1%, or at least about 5%, or at least about 10%; and/or (vi) porosity enhancing (i.e., porosity reducing) attributes of the microfibrillated cellulose is increased by at least about 1%, or at least about 5%, or at least about 10%, or at least about 20%, or at least about 30%, or at least about 40%, or at least about 50%, or at least about 60%, or at least about 70%, or at least about 80%; and/or (vii) smoothness enhancing attributes of the microfibrillated cellulose is increased by is at least about 1%, or at least about 5%, or at least about 10%, or at least about 20%, or at least about 30%; and and/or (viii) opacity enhancing attributes of the microfibrillated cellulose is increased by at least about 0.10%, or at least about 0.15%, or at least about 0.20%, or at least about 0.25%, or at least about 0.30%.

11a. A method according to numbered paragraphs 5a or 6a, wherein following completion of grinding and prior to high shear treatment the microfibrillated cellulose-containing product is washed out of the microfibrillation apparatus with water or any other suitable liquid.

12a. A process according to any one of numbered paragraphs 1a to 11a, where the aqueous suspension comprising microfibrillated cellulose is stirred in a mixing tank prior to high shear and/or during the process.

13a. A process according to any one of numbers paragraphs 1a to 12a, wherein the aqueous suspension comprising microfibrillated cellulose and optional inorganic particulate material subjected to high shear has a solids content of no greater than about 25 wt. %, and/or a fibre solids content of no greater than about 8 wt. %.

14a. A process according to any one of numbered paragraphs 1a to 13a, wherein the one or more paper property is selected from: (i) paper burst strength; (ii) burst index; (iii) tensile strength, (iv) z-direction (Internal (Scott) bond) strength, (v) tear strength), (vi) porosity, (vii) smoothness, and (viii) opacity.

15a. A process according to any one of numbered paragraphs 1a to 14a, further comprising preparing a papermaking composition comprising microfibrillated cellulose, and optionally inorganic particulate material, obtainable by the process of any preceding claim, optionally further comprising preparing a paper product from the papermaking composition.

16a. An aqueous suspension comprising microfibrillated cellulose, and optionally inorganic particulate material, obtainable by the process of any one of numbered paragraphs 1a to 14a.

17a. A papermaking composition obtainable by the process of claim 15a.

18a. A paper product obtainable by the process of claim 15a, wherein the paper product has:

(i) a first burst strength which is greater than a second burst strength of a comparable paper product comprising an equivalent amount of microfibrillated cellulose as defined in any one of claims 1 and 4 (prior to high shear); and/or (ii) a first burst index which is greater than a second burst index of a comparable paper product comprising an equivalent amount of microfibrillated cellulose as defined in any one of claims 1 and 4 (prior to high shear); and/or (iii) a first tensile strength which is greater than a second tensile strength of a comparable paper product comprising an equivalent amount of microfibrillated cellulose as defined in any one of claims 1 and 4 (prior to high shear), and/or (iv) a first z-direction (Internal (Scott) bond) strength which is greater than a second z-direction (Internal (Scott) bond) strength of a comparable paper product comprising an equivalent amount of microfibrillated cellulose as defined in any one of claims 1 and 4 (prior to high shear); and/or (v) a first tear strength which is greater than a second tear strength of a comparable paper product comprising an equivalent amount of microfibrillated cellulose as defined in any one of claims 1 and 4 (prior to high shear); and/or (vi) a first porosity which is lower than a second burst strength of a comparable paper product comprising an equivalent amount of microfibrillated cellulose as defined in any one of claims 1 and 4 (prior to high shear); and/or (vii) a first smoothness which is greater than a second smoothness of a comparable paper product comprising an equivalent amount of microfibrillated cellulose as defined in any one of claims 1 and 4 (prior to high shear); and/or (viii) a first opacity which is greater than a second opacity of a comparable paper product comprising an equivalent amount of microfibrillated cellulose as defined in any one of claims 1 and 4 (prior to high shear) optionally wherein the paper product comprises from about 0.1 to about 5% by weight microfibrillated cellulose and optionally up to about 50% by weight inorganic particulate material.

EXAMPLES

Materials

Wood pulp: Northern bleached softwood kraft pulp (Botnia RM90 from MetsaBotnia, soaked for 4 hours)

Inorganic particulate:

(1) ground calcium carbonate having a particle size distribution such that about 60 wt. % of the particles have an e.s.d. of less than 2 μm (2) kaolin particulate having a particle size distribution such that about 50 wt. % of the particles have an e.s.d. of less than 2 μm Apparatus and Experimental Procedures Tower Mill Production The tower mill used was a 15 kW vertical mill comprised of a vertical column with an inner diameter of 250 mm and a vertical impeller shaft having a circular cross section and a diameter of 220 cm. The feed which consisted of 6.4% of inorganic particulate (1) or (2) and 1.6% fiber content (correspond to the total dry weight of fibre in the wood pulp) was prepared in a mixing tank prior to the grinding process. The grinding process was performed at 500 rpm shaft speed using 3 mm zirconia grinding media with the pulp and filler mixture being fed from the bottom of the grinder. The samples were ground to an energy inputs over the range of 0-5000 kWh/t of fiber by adjusting the federate of the pulp mixture.

Stirred Media Detritor (SMD) Grinder Production

The SMD grinder used was a 185 kW Bottom Screened Detritor. The impellers have a cylindrical cross section.

For each experiment, the grinder was charged with grinding media, pulp, inorganic particulate (1) and water. The grind was stopped when it reached a pre-determined energy set point. To collect the product, water was added into the grinder to dilute the product before being be discharged into storage tanks.

The diluted product was stored in storage tanks to allow gravity thickening for approximately 1-2 days. The clear supernatant was then removed so that the final product had a total solids content of ~8.0%.

High Solids Cake Production

For high solids cake sample preparation, the diluted product before the gravity thickening stage was dewatered using a lab scale centrifuge decanter (Sharples P600). Prior to the dewatering stage, the centrifuge was configured by adjusting the pond depth to a medium setting and limiting the differential speed (difference between the bowl and scroll speed). This differential speed was set at 10 rpm whilst maintaining a maximum bowl speed of 2500 rpm.

In-Line High Shear Treatment

For each experiment, approximately 100 L of 8% solids (water was added if solids was >8%) of grinder product was measured into a mixing tank and homogenously mixed for at least 1 minute. The mixed product was then passed through an in-line Silverson mixer, where the high shearing action took place, and recycled back to the mixing tank. The product was re-circulated at constant flow and 500 ml of sample was collected from the drain valve at a time interval of 5, 10, 15, 20, 25, 30, 40, 50, 60, 90 minutes. The energy input, E, by the Silverson mixer was calculated as, $$E = \frac{P}{MFC}$$

where E is total energy input per tonne of fibre (kWh/t), P is the total energy input (kWh) and MFC is the total weight of fibre in the product (tonne).

Viscosity Test

Samples of grinder product were diluted with sufficient water to give a fibre content of 1.5 wt %. The diluted samples were mixed well and their viscosity measured using a Brookfleld R.V. viscometer (Spindle No 4) at 10 rpm. For each sample the reading was taken after 15 seconds to allow it to stabilise.

Particle Size Distribution Measurement

Prior to the test, a dispersant solution was mixed into the sample (5 ml of 1.5% sodium polyacrylate per 3 g dry product) and the mixture was topped up to 80 ml using deionized water. The particle size distribution of all the samples were then measured using a Mastersizer 'S' (Malvern, UK).

Rapid Handsheet Test

The products prepared according to the above procedures were evaluated as fillers in handsheets. Generally, a batch of bleached chemical pulp comprising 70 parts eucalyptus and 30 parts northern bleached softwood pulp was beaten in a valley beater to give a CSF of 520 $cm^3$. After disintegration and dilution to 2% thick stock, the fibre was diluted to 0.3 wt. % consistency for sheet making.

Filler slurry (comprising the post-high sheared microfibrillated cellulose and inorganic particulate) was added together with retention aid (Ciba, Percol 292, 0.02 wt. % on furnish). Handsheets were made to a basis weight of 80 $gm^{-2}$ using a British handsheet mold according to standard methods (e.g. SCAN C 26:76 (M 5:76). Sheets were prepared at approximately 15 and 25 parts inorganic particulate loading and the burst strength value at 20% inorganic particulate loading interpolated from these data. The burst at 20% loaded was expressed as a percentage of the unfilled value.

Paper burst strength was determined using a Messemer Buchnel burst tester according to SCAN P24.

Experiment 1—SMD Sample

The SMD grinder product for Experiment 1 consisted of a total solids of 10% and a fibre solids content of 2%.

The SMD grinder product was then high shear treated at an energy input over a range of 0-1000 kWh/t fibre. Results are summarized in Table 1.

TABIE 1

| Sample | Energy input (kWh/t) | Burst strength (% of unfilled at 20% filler loading) | Improvement (% of increases relative to sample SMD/0) |
|---|---|---|---|
| SMD/0 | 0 | 84 | — |
| SMD/5 | 100 | 86 | 2.70 |
| SMD/10 | 200 | 88 | 4.53 |
| SMD/15 | 300 | 91 | 7.86 |
| SMD/20 | 400 | 90 | 6.68 |
| SMD/30 | 600 | 89 | 5.90 |
| SMD/40 | 800 | 92 | 10.06 |
| SMD/60 | 1000 | 93 | 11.00 |

'SMD/20', for example, means the SMD grinder product which is withdrawn from the in-line high shear treatment at a time interval of 20 minutes.

The burst strength follows an increasing trend when the specific input energy during the high shear treatment increases.

For example, sample the burst strength of the sample has an improvement as high as 11% compared to un-treated sample at 1000 kWh/t of fibre. In other words, the paper burst strength enhancing attributes of the post-high shear microfibrillated cellulose are Improved by up to 11%.

Experiment 2—SMD 'High Solids' Sample

The total solids of the decanted SMD grinder product was 30% and the fibre solids was 6%.

Prior to the high shear treatment, the high solids cake was made down to 8.5% solids by mixing in water in a mixing tank.

The grinder product was high shear treated at an energy input over a range of 0-3000 kWh/t fibre. Results are summarized in Table 2.

TABLE 2

| Sample | Energy input (kWh/t) | Brookfield viscosity @ 1.5% fiber solid 10 rpm (mPa · s) | Malvern 'S' fiber $d_{50}$ (μm) | Burst strength (% of unfilled at 20% filler loading) | Improvement (% of increases relative to original sample) |
|---|---|---|---|---|---|
| ST/High Solid/A | 0 | 4600 | 122.6 | 81 | — |
| ST/High Solid/B | 100 | 5600 | 124.9 | 84 | 3.7 |
| ST/High Solid/C | 200 | 5600 | 120.6 | 85 | 4.9 |
| ST/High Solid/D | 300 | 5400 | 117.0 | 86 | 6.2 |
| ST/High Solid/E | 500 | 4200 | 120.9 | 85 | 4.9 |
| ST/High Solid/F | 700 | 5600 | 116.5 | 90 | 11.1 |
| ST/High Solid/G | 1000 | 5800 | 114.4 | 87 | 7.4 |
| ST/High Solid/H | 1250 | 5200 | 120.3 | 90 | 11.1 |
| ST/High Solid/I | 1500 | 5400 | 112.3 | 90 | 11.1 |

Again, the burst strength of the high shear treated samples increases with the increasing energy input.

Experiment 3—Tower Mill Sample

The tower mill product had a total solids content of 8% and the fibre content was 1.6%.

The tower mill product was high shear treated at an energy input over a range of 0-2500 kWh/t fibre. Results are summarized in Table 3.

TABLE 3

| Sample | Energy input (kWh/t) | Brookfield viscosity @ 1.5% fiber solid 10 rpm (mPa · s) | Malvern 'S' fiber $d_{50}$ (μm) | Burst strength (% of unfilled at 20% filler loading) | Improvement (% of increases relative to original sample) |
|---|---|---|---|---|---|
| ST/HKU/A | 0 | 3220 | 160.3 | 70 | — |
| ST/HKU/B | 250 | 5000 | 161.0 | 71 | 1.4 |
| ST/HKU/C | 500 | 3640 | 153.4 | 72 | 2.9 |
| ST/HKU/D | 800 | 4000 | 146.9 | 75 | 7.1 |
| ST/HKU/E | 1000 | 3580 | 151.3 | 75 | 7.1 |
| ST/HKU/F | 1300 | 4200 | 141.9 | 75 | 7.1 |
| ST/HKU/G | 1600 | 5200 | 143.2 | 74 | 5.7 |
| ST/HKU/H | 2500 | 5200 | 140.9 | 73 | 4.3 |

The paper burst strength of the high shear treated samples increase as the specific input energy increases.

Experiment 4—Tower Mill Sample-Higher Energy Input

The tower mill product had a total solids content of 8% and the fibre content was 1.6%.

The tower mill product was high shear treated at an energy input over a range of 0-4000 kWh/t fibre. Results are summarized in Table 4.

TABLE 4

| Sample | Energy input (kWh/t) | Brookfield viscosity @ 1.5% fiber solid 10 rpm (mPa · s) | Malvern 'S' fiber $d_{50}$ (μm) | Burst strength (% of unfilled at 20% filler loading) | Improvement (% of increases relative to original sample) |
|---|---|---|---|---|---|
| ST/HKA/A | 0 | 4200 | 151.0 | 68 | — |
| ST/HKA/B | 1000 | 4200 | 129.9 | 72 | 5.9 |
| ST/HKA/C | 1500 | 4800 | 131.1 | 73 | 7.4 |
| ST/HKA/D | 2000 | 5800 | 126.4 | 74 | 8.8 |
| ST/HKA/E | 2500 | 6000 | 124.0 | 75 | 10.3 |
| ST/HKA/F | 3000 | 5600 | 117.6 | 77 | 13.2 |
| ST/HKA/G | 3500 | 5800 | 116.5 | 78 | 14.7 |
| ST/HKA/H | 4000 | 5400 | 118.1 | 79 | 16.2 |

The paper burst strength of the high shear treated samples increase as the specific input energy increases.

Experiment 5—Tower Mill Sample—Inorganic Particulate (2)

The tower mill product had a total solids content of 8% and the fibre content was 1.6%.

The tower mill product was high shear treated at an energy Input over a range of 0-3250 kWh/t fibre. Results are summarized in Table 5.

TABLE 5

| Sample | Energy input on actual POP (kWh/t) | Brookfield viscosity @ 1.5% fiber solid 10 rpm (mPa · s) | Malvern 'S' fiber $d_{50}$ (μm) | Burst strength (% of unfilled at 20% filler loading) | Improvement (% of increases relative to original sample) |
|---|---|---|---|---|---|
| ST/HKQ/A | 0 | 3660 | 140.9 | 67 | — |
| ST/HKQ/B | 100 | 3780 | 124.0 | 72 | 7.5 |
| ST/HKQ/C | 300 | 4200 | 126.1 | 71 | 6.0 |
| ST/HKQ/D | 500 | 4200 | 123.2 | 72 | 7.5 |
| ST/HKQ/E | 750 | 3940 | 117.0 | 75 | 11.9 |
| ST/HKQ/F | 1000 | 4800 | 115.1 | 76 | 13.4 |
| ST/HKQ/G | 2000 | 4600 | 104.1 | 76 | 13.4 |
| ST/HKQ/H | 3250 | 5400 | 102.3 | 78 | 16.4 |

The paper burst strength of the high shear treated samples increase as the specific input energy increases.

Example 6

A batch of co-ground microfibrillated cellulose and ground calcium carbonate filler was prepared in accordance with the procedures described above (using an SMD). A portion of the co-ground material was subjected to high shear treatment; approximately 100 L of 8% solids (water was added if solids was >8%) of grinder product was measured Into a mixing tank and homogenously mixed for at least 1 minute. The mixed product was then passed through an in-line Silverson mixer, where the high shearing action took place.

Properties of the as-prepared co-ground material and high shear treated material are summarized in Table 6.

TABLE 6

| Sample | Solids % | POP % | Brookfield viscosity at 11.5% fibre solids, mPa · s 10 rpm | 20 rpm | 50 rpm | 100 rpm |
|---|---|---|---|---|---|---|
| Co-ground MFC | 8.7 | 20.0 | 4200 | 2500 | 1240 | 940 |
| High sheer-treated co-ground MFCp | 8.0 | 20.0 | 6200 | 3500 | 1760 | 1140 |

Papermaking

A blend of 70% by weight of eucalyptus pulp and 30% Botnia RMA 90 softwood kraft pulp was prepared at 3% solids in water using a pilot scale hydrapulper and refined to a freeness of 30° SR using a pilot scale refiner.

This pulp blend was used to make a continuous reel of paper using a pilot scale Fourdrinier machine running at 12 m $min^{-1}$. The target grammage of the paper was 80±5 $gm^{-2}$. The papermachine drainage water was recirculated to ensure full retention of all the added components.

Blends of each sample were made with additional ground calcium carbonate (of the type described above) using a low shear mixer in order to provide a range of four POP (Percentage Of Pulp—percentage of the filler dry weight that is pulp) levels from 3, 5, 7 and 9% for each filler. These were then mixed with the previously prepared pulp in the papermachine to make paper sheets with a filler loading of 30% and a range of MFC values from 1-3% In the finished sheet. Paper comprising a control GCC filler (i.e., the calcium carbonate as described above) was also prepared having a GCC filler loading of 20% without microfibrillated cellulose. A cationic polymeric retention aid (Percol E622, BASF) was added at doses of 200 g $t^{-1}$ and 250 g $t^{-1}$. The paper was dried using heated cylinders.

Paper Properties

Sheets of the finished paper were conditioned in a controlled atmosphere (23° C. and 50% RH) overnight before testing for the following:

Paper strength (burst, MD tensile, CD tear, Scott bond)

Porosity (Bendtsen)

Smoothness (Bendtsen)

Opacity

Each test was conducted in accordance with the methodology described above.

Results were plotted for a mineral loading of 30% and interpolated to a MFC level of 2% in the sheet. These were compared to the control filler at 20% loading. Table 7 below summarises the results.

TABLE 7

| Test | Control GCC | Co-ground MFC | High shear treated co-ground MFC |
|---|---|---|---|
| Burst index, kPa $m^2$ $g^{-1}$ | 1.07 | 1.23 | 1.36 |
| Machine direction tensile index, Nm $g^{-1}$ | 31.1 | 31.2 | 33.3 |
| Cross direction tear index, mN $m^2$ $g^{-1}$ | 5.34 | 5.42 | 5.88 |
| Internal (Scott) bond strength, J $m^{-2}$ | 79 | 129 | 192 |
| Bendtsen porosity, $cm^3$ $min^{-1}$ | 3750 | 1050 | 800 |
| Bendtsen smoothness, $cm^3$ $min^{-1}$ | 720 | 555 | 695 |
| Opacity, 80 $gm^{-2}$, % | 86.9 | 88.9 | 89.1 |

The invention claimed is:

1. A method for producing microfibrillated cellulose with enhanced attributes for the production of a paper product, comprising:

(a) processing at a first location an aqueous suspension of a fibrous substrate comprising cellulose and one or more additives selected from flocculants, preservatives and biocides into a first processed microfibrillated cellulose; wherein the fibrous substrate comprising cellulose is optionally ground in the presence of one or more inorganic particulate material; and wherein the first processed microfibrillated cellulose is characterized by a fibre steepness of from about 20 to about 50, and a fibre $d_{50}$ of at least 50 μm;

(b) dewatering the first processed microfibrillated cellulose and optionally added one or more inorganic particulate material to form the first processed and dewatered microfibrillated cellulose;

(c) transporting the first processed and dewatered microfibrillated cellulose and optionally added one or more inorganic particulate material, to a second location; and (d) further processing at the second location, the first processed and dewatered microfibrillated cellulose, and optionally added one or more inorganic particulate material, by subjecting an aqueous suspension comprising the first processed and dewatered microfibrillated cellulose and optionally added one or more inorganic particulate material to high shear, wherein the high shear is generated, at least in part, by a moving shearing element, to improve the enhancing attributes of the microfibrillated cellulose for the production of paper, and wherein the term "high shear" means a shear rate of from about 20,000 $s^{-1}$ to about 120,000 $s^{-1}$;

wherein, following high shear, the paper burst strength enhancing attributes of the microfibrillated cellulose is increased by at least about 1% for a paper product made from a papermaking composition comprising microfibrillated cellulose made after said high shear to a comparable paper product comprising an equivalent amount of microfibrillated cellulose prior to said high shear.

2. The method according to claim 1, wherein the first processed microfibrillated cellulose is obtained by a process comprising grinding a fibrous substrate comprising cellulose in an aqueous environment in the presence of a grinding medium, and in the presence of one or more inorganic particulate material, selected from the group consisting of an alkaline earth metal carbonate and sulphate, a hydrous kandite clay, an anhydrous (calcined) kandite clay, talc, mica, perlite, diatomaceous earth, magnesium hydroxide, and aluminium trihydrate, or any combination thereof.

3. The method according to claim 2, wherein the one or more inorganic material is selected from the group consisting of calcium carbonate, natural calcium carbonate, precipitated calcium carbonate, magnesium carbonate, dolomite, gypsum, kaolin, halloysite, ball clay, metakaolin, and fully calcined kaolin.

4. The method according to claim 1, wherein the dewatering step (b) comprises one or more steps for removal of water selected from gravity; vacuum-assisted drainage, with or without pressing; pressing; evaporation; and filtration, or by any combination of these steps.

5. The method according to claim 2, wherein the dewatering step (b) comprises one or more steps for removal of water selected from gravity; vacuum-assisted drainage, with or without pressing; pressing; evaporation; and filtration, or by any combination of these steps.

6. The method according to claim 1, wherein the one or more additive is selected from the group consisting of one or more cationically modified polyacrylamide flocculant, one or more BIT (2-Benzisothiazoline-3-one), CMIT (5-chloro-2-methyl-4-isothiazolin-3-one), MIT (Methylisothiazolinone) biocides, DBNPA biocide, hydrogen peroxide, glutaraldehyde, and THPS (Tetrakis(hydroxymethyl) phosphonium sulfate), or any combination thereof.

7. The method according to claim 2, wherein the one or more additive is selected from the group consisting of one or more cationically modified polyacrylamide flocculants, one or more BIT (2-Benzisothiazoline-3-one), CMIT (5-chloro-2-methyl-4-isothiazolin-3-one), MIT (Methylisothiazolinone) biocides, DBNPA biocide, hydrogen peroxide, glutaraldehyde, and THPS (Tetrakis(hydroxymethyl) phosphonium sulfate), or any combination thereof.

8. The method according to claim 1, wherein the first processed and dewatered microfibrillated cellulose is in the form of a partially dried or essentially dried product.

9. The method according to claim 2, wherein the first processed and dewatered microfibrillated cellulose, and one or more inorganic particulate material, are in the form of a partially dried or essentially dried product.

10. The method according to claim 8, wherein the water content of the first processed microfibrillated cellulose is reduced to less than 80% by volume, based on the total volume of water in the first processed microfibrillated cellulose prior to removal of water, before being transported to the second location.

11. The method according to claim 9, wherein the water content of the first processed microfibrillated cellulose, and one or more inorganic particulate material, is reduced to less than 80% by volume, based on the total volume of water in the first processed microfibrillated cellulose and one or more inorganic particulate material, prior to removal of water, before being transported to the second location.

12. The method according to claim 8, wherein the water content of the first processed microfibrillated cellulose is reduced to less than 10% by volume, based on the total volume of water in the first processed and dewatered microfibrillated cellulose before being transported to the second location.

13. The method according to claim 9, wherein the water content of the first processed microfibrillated cellulose, and one or more inorganic particulate material, is reduced to less than 10% by volume, based on the total volume of water in the first processed and dewatered microfibrillated cellulose, and one or more inorganic particulate material, before being transported to the second location.

14. The method according to claim 8, wherein the partially dried or essentially dried product are incorporated into a papermaking composition or a paper product.

15. The method according to claim 9, wherein the first processed, dewatered and high shear processed microfibrillated cellulose, and one or more inorganic particulate material, are incorporated into a papermaking composition or a paper product.

16. The method according to claim 1, wherein the first processed, dewatered and high shear processed microfibrillated cellulose, is incorporated into a papermaking composition or a paper product.

17. The method according to claim 2, wherein the first processed, dewatered and high shear processed microfibrillated cellulose, and one or more inorganic particulate material, are incorporated into a papermaking composition or a paper product.

18. The method according to claim 2, wherein when the inorganic particulate material is, (i) calcium carbonate, optionally wherein at least 50 wt. % of the calcium carbonate has an e.s.d. of less than 2 μm, or (ii) kaolin, optionally where at least 50 wt. % of the kaolin has an e.s.d. of less than 2 μm.

19. The method according to claim 1, wherein the fibre $d_{50}$ of the first processed and dewatered microfibrillated cellulose is, following high shear, reduced by at least 1%.

20. The method according to claim 1, wherein the fibre $d_{50}$ of the first processed and dewatered microfibrillated cellulose is, following high shear, reduced by at least 5%.

21. The method according to claim 1, wherein the fibre $d_{50}$ of the first processed and dewatered microfibrillated cellulose is, following high shear, reduced by at least 10%.

22. The method according to claim 1, wherein the fibre $d_{50}$ of the first processed and dewatered microfibrillated cellulose is, following high shear, reduced by at least 50%.

23. The method according to claim 2, wherein the fibre $d_{50}$ of the first processed and dewatered microfibrillated cellulose is, following high shear, reduced by at least 1%.

24. The method according to claim 2, wherein the fibre $d_{50}$ of the first processed and dewatered microfibrillated cellulose is, following high shear, reduced by at least 5%.

25. The method according to claim 2, wherein the fibre $d_{50}$ of the first processed and dewatered microfibrillated cellulose is, following high shear, reduced by at least 10%.

26. The method according to claim 2, wherein the fibre $d_{50}$ of the first processed and dewatered microfibrillated cellulose is, following high shear, reduced by at least 50%.

* * * * *